US005818156A

United States Patent [19]

Misono

[11] Patent Number: 5,818,156

[45] **Date of Patent: *Oct. 6, 1998**

[54] COLOR CATHODE-RAY TUBE

[75] Inventor: Masayoshi Misono, Chiba-ken, Japan

[73] Assignee: Hitachi, Ltd., Tokyo, Japan

[ * ] Notice: The term of this patent shall not extend beyond the expiration date of Pat. No. 5,585,690.

[21] Appl. No.: 687,382

[22] PCT Filed: Feb. 3, 1995

[86] PCT No.: PCT/JP95/00143

§ 371 Date: Aug. 5, 1996

§ 102(e) Date: Aug. 5, 1996

[87] PCT Pub. No.: WO95/21456

PCT Pub. Date: Aug. 10, 1995

[30] Foreign Application Priority Data

Feb. 7, 1994 [JP] Japan ..... 6-013633

[51] Int. Cl.[6] ..... H01J 29/50

[52] U.S. Cl. ..... 313/412; 313/413; 313/414

[58] Field of Search ..... 313/412, 414, 313/428, 432, 437, 439, 460, 413

[56] References Cited

U.S. PATENT DOCUMENTS

| | | | |
|---|---|---|---|
| 4,725,763 | 2/1988 | Okuyama et al. | 313/412 |
| 4,900,979 | 2/1990 | Shimoma et al. | 313/412 |
| 5,157,301 | 10/1992 | Tominaga et al. | 313/412 |
| 5,384,512 | 1/1995 | Kamoharu et al. | 313/414 |

*Primary Examiner*—George Dombroske
*Assistant Examiner*—Harshad Patel
*Attorney, Agent, or Firm*—Antonelli, Terry, Stout & Kraus, LLP

[57] ABSTRACT

A color cathode-ray tube which is provided with deflection error correcting electrodes for correction deflection errors in accordance with the deflected amounts of electron beams by forming a nonuniform electric field in a deflecting magnetic field and has a function of adjusting the deflected amounts of two side electron beams on both sides of a central electron beam of three electron beams from an electron gun and the deflected amount of the central electron beam. The focusing characteristic and resolution of the cathode ray tube are improved over the whole screen and over the whole current ranges of the electron beams without supplying any dynamic focusing voltage. The coma aberration is reduced and the cathode-ray tube can use a low-cost deflection yoke.

17 Claims, 19 Drawing Sheets

COLOR CATHODE-RAY TUBE

TECHNICAL FIELD

The present invention relates to a color cathode-ray tube and particularly to a color cathode-ray tube equipped with an electron gun capable of obtaining good resolution by improving focusing characteristics over the whole fluorescent plane and over the whole current zone of an electron beam, the color cathode-ray tube employing deflecting yokes of a short overall length and of a low cost, enabling the depth of the cabinet of the picture display device to be shortened.

BACKGROUND ART

In a cathode-ray tube equipped with at least an electron gun constituted by a plurality of electrodes, a deflecting device and a fluorescent screen (screen having a phosphor coating), the following technologies have heretofore been known as means for obtaining good reproduced picture from the center up to the periphery of the fluorescent screen.

Technology in which coma correction coils are provided at right and left positions on the deflection yokes close to a neck portion of the cathode-ray tube that use three electron beams arranged in line, in order to correct the coma (Japanese Utility Model Laid-Open No. 40944/1985).

Technology in which narrow pieces of a magnetic material are arranged near the apertures for passing electron beams of both sides among the three electron beams arranged in line on the bottom surface of a shield cup of an electron gun that uses three electron beams arranged in line, in order to adjust the amounts of deflection individually for the electron beams of both sides and for the central electron beam (Japanese Patent Laid-Open No. 82770/1973).

Technology in which two pieces of upper and lower parallel flat-plate electrodes are arranged being faced to the main lens sandwiching the passage of three electron beams, the two pieces of upper and lower parallel flat-plate electrodes being installed on the bottom surface of a shield cup of an electron gun which uses three electron beams arranged in line (Japanese Patent Publication No. 52586/1992).

Technology in which two pieces of upper and lower parallel flat-plate electrodes are arranged being directed to the fluorescent screen from a portion opposed to the main lens in an electron gun which uses three electron beams arranged in line, the three electron beams being sandwiched between the two pieces of upper and lower parallel flat-plate electrodes in parallel with the in-line direction, in order to shape the electron beams before the electron beams enter into the deflecting magnetic field (U.S. Pat. No. 4,086,513, Japanese Patent Publication No. 7345/1985).

There can be further quoted technology in which an electrostatic quadrupole lens is formed between electrodes in a portion of an electron gun, and the strength of the electrostatic quadrupole lens is dynamically changed depending upon the deflections of the electron beams in order to uniformalize the picture on the whole screen (Japanese Patent Laid-Open No. 61766/1976); technology in which an astigmatic lens is provided in a region of electrodes (second electrode and third electrode) forming a spare focusing lens (Japanese Patent Laid-Open No. 18866/1978); technology in which apertures in the first electrode and in the second electrode for passing electron beams are transversely elongated or the electrodes are formed in different shapes in an electron gun that use three electron beams arranged in line, or the transverse-to-longitudinal ratio of the apertures for passing the electron beams in a central electron gun is set to be smaller than that of side electron guns (Japanese Patent Laid-Open No. 64368/1976); and technology in which an asymmetrical lens is created by slits formed in the third electrodes on the cathode side in the electron guns arranged in line, and the slits in the axial direction of the electron guns are formed deeper toward the center beam than toward the side beams, so that electron beams are projected onto the fluorescent screen through the asymmetrical lens of at least one place (Japanese Patent Laid-Open No. 81736/1985).

The focusing characteristics in the cathode-ray tube must be such that good resolution is obtained at the center of the screen and over the whole current zone of the electron beams, and that the resolution on the whole screen must be uniform over the whole current zone.

When the cathode-ray tube is used for the picture display device, furthermore, it is desired that the cabinet accommodating the picture display device has a short depth so that it can be put on a narrow place and that the picture display device is constituted by employing deflecting yokes and drive circuits of low costs to be competitive in the markets. Sophisticated technology is required for designing the cathode-ray tube that simultaneously satisfies such a plurality of characteristics.

In order to obtain a cathode-ray tube satisfying the above-mentioned characteristics, it was learned according to the study conducted by the present inventors that it is essential to provide an electron gun having a function capable of correcting the deflection error and further having a main lens of a large diameter, the electron gun further enabling the distance to be shortened between the main lens and the fluorescent screen and making it possible to partly adjust the deflecting magnetic field.

According to the above-mentioned technologies, however, a dynamic focusing voltage must be applied to the focusing electrodes in an electron gun in order to obtain a good resolution over the whole screen by using an astigmatic lens for the electron gun to correct deflection error and by using an electrode for creating an asymmetrical lens.

FIG. 31 is a sectional view illustrating part of an electron gun for a color cathode-ray tube using three electron beams arranged in line, wherein reference numeral 1 denotes a first electrode ($G_1$), 2 denotes a second electrode ($G_2$), 3 denotes a third electrode ($G_3$), 4 denotes a fourth electrode ($G_4$), 5 denotes a fifth electrode ($G_5$), 6 denotes a sixth electrode ($G_6$), 30 denotes a shield electrode, 38 denotes a main lens, and symbol K denotes a cathode.

In this electron gun, the fifth electrode 5 is a focusing electrode and a sixth electrode 6 is an anode, and between these electrodes is formed the main lens 38 for shaping the electron beams. The shield electrode 30 is connected to the sixth electrode 6. When the electron gun is used for the cathode-ray tube, the shield electrode 30 is installed on a side close to the fluorescent screen, so that the electron beams shaped by the main lens 38 are little affected by the external environment such as deflecting magnetic field and terrestrial magnetism.

FIG. 32 is a schematic sectional view comparing major portions of an electron gun depending upon how to apply a focusing voltage, wherein the diagram (a) illustrates a system for applying a fixed focusing voltage and the diagram (b) illustrates a system for applying a dynamic focusing voltage.

The electron gun of the type of applying a fixed focusing voltage of FIG. 32(*a*) has the electrode constitution which is the same as the one shown in FIG. 31, and the portions having the same functions are denoted by the same reference numerals.

In the electron gun of the type of applying a fixed focusing voltage of FIG. 32(*a*), the same focusing voltage $Vf_1$ is applied to the electrodes 51 and 52 constituting the fifth electrode 5.

In the electron gun of the type of applying a dynamic focusing voltage of FIG. 32(*b*), on the other hand, different focusing voltages $Vf_1$ and $Vf_2$ are fed to the fifth electrode 5 constituted by two electrodes 51 and 52. In particular, to one electrode 52 is fed a dynamic focusing voltage dvf being superposed on $Vf_2$. Furthermore, the electron gun of the type of applying a dynamic focusing voltage has a portion extending into another electrode as designated at 43 and, hence, becomes complex in structure compared to the electron gun shown in FIG. 32(*a*), uses costly parts, and can be assembled accompanied by decreased operation efficiency.

FIG. 33 is a diagram for explaining the focusing voltage to be applied to the electron gun shown in FIG. 32, wherein the diagram (a) illustrates the waveform of a focusing voltage in the electron gun of the type of applying a fixed focusing voltage and the diagram (b) illustrates the waveform of a focusing voltage in the electron gun of the type of applying a dynamic focusing voltage.

In the diagram (b), there are used a fixed focusing voltage $Vf_1$ as well as a voltage of the waveform obtained by superposing a dynamic focusing voltage $Vf_2$ on another fixed focusing voltage $Vf_{20}$. In the electron gun of the type of applying a dynamic focusing voltage of FIG. 32(*b*), therefore, the stem of the cathode-ray tube requires two pins for applying the focusing voltage, and insulation must be maintained from other stem pins requiring more careful attention than that required for the electron gun of the type of applying a fixed focusing voltage of FIG. 32(*a*). This means that a socket to be incorporated in a television set must be constructed in a special structure, and a circuit must be provided for generating a dynamic focusing voltage in addition to two power sources for generating fixed focusing voltages, and further requiring a time for adjusting the focusing voltages in a line for assembling the television sets.

When a maximum deflecting angle of the electron beam remains the same in a cathode-ray tube, the distance increases between the fluorescent screen and the main lens of the electron gun with an increase in the size of the fluorescent screen, and the focusing characteristics decrease due to repulsion of space charge of the electron beam acting on this region.

Therefore, if means is accomplished for shortening the distance between the main lens of the electron gun and the fluorescent screen, a fine electron beam is obtained like when the size of the fluorescent screen is decreased, making it possible to enhance the resolution of the cathode-ray tube.

A decrease in the distance between the main lens of the electron gun and the fluorescent screen results in an increase in the amount of deflection error and a decrease in the resolution in the periphery of the screen. According to the above-mentioned prior art, therefore, it is required to further increase the dynamic focusing voltage accompanied by an increase in the cost of fabricating the drive circuits and an increase in the technical and economical burden for the picture display device from the standpoint of enhancing insulating performance of the socket for the cathode-ray tube.

An object of the present invention is to provide a color cathode-ray tube equipped with an electron gun which features improved focusing characteristics on the whole screen and on the whole current zones of electron beams without applying a dynamic focusing voltage, making it possible to obtain good resolution, eliminating problems inherent in the above-mentioned prior art, and to employ a low-cost focusing power source circuit as a result of using the above color cathode-ray tube for the picture display device, as well as to facilitate the operation for setting the focusing conditions.

Another object of the present invention is to provide a color cathode-ray tube equipped with an electron gun which features improved focusing characteristics on the whole screen and on the whole current zones of electron beams despite of the application of a small dynamic focusing voltage, making it possible to obtain good resolution.

A further object of the present invention is to provide a color cathode-ray tube which suppresses a reduction in the focusing characteristics caused by the repulsion of space charge of electron beams acting between the fluorescent screen of the color cathode-ray tube and the main lens of the electron gun.

A still further object of the present invention is to provide a color cathode-ray tube equipped with an electron gun which is capable of improving focusing characteristics as well as shortening the overall length of the color cathode-ray tube, enabling the depth of the cabinet of the picture display device to be shortened.

The depth of a modern television set is determined by the overall length of the cathode-ray tube. If the television set is considered as furniture, then, it is desired to be small in depth. The television sets having small depths are also desired from the standpoint of transportation.

A yet further object of the present invention is to provide a color cathode-ray tube equipped with an electron gun that does not permit the loss of uniformity of picture over the whole screen when the angle of deflection of the color cathode-ray tube is widened, enabling the depth of the cabinet of the picture display device to be shortened. The overall length of the cathode-ray tube can be shortened even when the angle of deflection is widened.

In order to partly adjust the deflecting magnetic field according to the prior art, furthermore, the electron gun must be provided with narrow pieces made of a magnetic material.

Another object of the present invention is to provide a color cathode-ray tube which makes it possible to partly adjust the deflecting magnetic field without using at least part of narrow pieces made of the magnetic material, permitting the use of deflecting yokes of a low cost.

DISCLOSURE OF THE INVENTION

The present invention employs the following means in order to solve the above-mentioned problems.

That is, a color cathode-ray tube comprising:

an electron gun constituted of cathodes for forming three electron beams in line, electrodes forming a main lens for shaping the electron beams, and a shield electrode arranged neighboring the electrodes forming the main lens along the tubular axis to protect the shaped electron beams from the external environment;

a deflection device generating a deflecting magnetic field to deflect the electron beams in the in-line direction and in a direction at right angles with the in-line direction; and a fluorescent screen which emits light when irradiated with the deflected electron beams to form a picture;

wherein the shield electrode of the electron gun is arranged in the region of the deflecting magnetic field of the deflecting device, deflection error correction electrodes are provided in shield electrode to form a nonuniform electric field to change the beam diameter depending upon the amount of deflection of the electron beams so that the resolution can be uniformized on the whole screen by correcting the deflection error without applying a dynamic voltage to the focusing electrode of the electron gun, and the electrodes for correcting the deflection error installed in the deflecting magnetic field to form a nonuniform electric field functions to adjust the amount of deflection individually for the two side electron beams and for the central electron beam. Here, the nonuniform electric field formed in the deflecting magnetic field serves as an astigmatic electric field and/or a coma electric field.

According to the above-mentioned means, the main lens of the electron gun is brought close to the fluorescent screen to decrease the effect of repulsion due to space charge, so that the resolution is enhanced at the center of the screen. At the same time, furthermore, the overall length of the color cathode-ray tube can be shortened.

By using the color cathode-ray tube having a decreased overall length for the picture display device, it is allowed to decrease the depth of the cabinet.

The above-mentioned constitution of the present invention exhibits the following actions.

A nonuniform electric field is formed in a fixed manner in the deflecting magnetic field formed by the deflecting device to correct the deflection error depending upon the amount of deflection. Here, the electrode for correcting the deflection error depending upon the amount of deflection by forming the nonuniform electric field functions to adjust the amount of deflection individually for the electron beam positioned at the center and for the electron beams positioned on both sides. This makes it possible to control the convergence on the whole region of the fluorescent screen even by using the deflecting yokes of a low cost without having function for correcting coma.

Owing to the action for correcting the deflection error depending upon the amount of deflection, furthermore, uniformity of resolution is enhanced on the whole fluorescent screen, the distance is shortened between the fluorescent screen and the main lens, effect of repulsion due to space charge is suppressed, and resolution is improved at the center of the fluorescent screen. Besides, not only the overall length is shortened but also the coma is decreased. By using the color cathode-ray tube for the picture display device, it is made possible to decrease color deviation of the picture, to display picture maintaining high quality and to decrease the depth of the cabinet.

BEST MODE FOR CARRYING OUT THE INVENTION

Embodiments of the present invention will now be described in detail with reference to the drawings.

Figure 1:
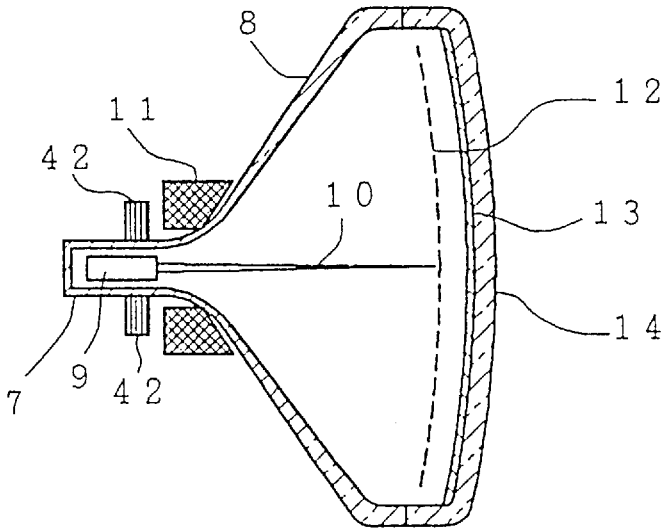
FIG. 1 (PRIOR ART)
FIG. 1 is a sectional view schematically illustrating a color cathode-ray tube using three electron beams arranged in line.

FIG. 1 is a sectional view schematically illustrating a color cathode-ray tube using three electron beams arranged in line, wherein reference numeral 7 denotes a neck portion, 8 denotes a funnel portion, 9 denotes an electron gun, 10 denotes an electron beam, 11 denotes a deflecting yoke, 12 denotes a color-selecting electrode, 13 denotes a phosphor coating (fluorescent screen), and 42 denotes a converging adjuster for the three electron beams 14 denotes a panel portion. Hereinafter, the same portions having the same functions are denoted by the same reference numerals.

Briefly describing the operation of the cathode-ray tube with reference to FIG. 1, a vacuum enclosure is formed by the neck portion 7, funnel portion 8 and panel portion 14. The electron gun 9 emits the shaped electron beams 10, and the deflecting yokes 11 deflect the electron beams 10 in a horizontal direction and in a vertical direction. The electron beams 10 are deflected toward the fluorescent screen 13 through the color-selecting electrode 12 and are allowed to impinge upon the fluorescent screen 13, whereby light is emitted to form a picture which is then observed through the panel portion 14.

Figure 2:
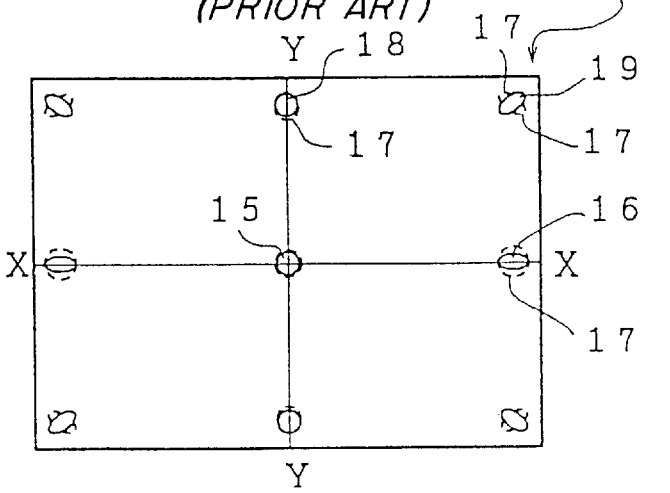
FIG. 2 (PRIOR ART)
FIG. 2 is a diagram schematically illustrating the state where spot light is emitted from a fluorescent film of the cathode-ray tube as viewed from the side of the panel.

The panel portion 14 usually has a nearly rectangular outer shape as shown in FIG. 2, and the fluorescent screen 13 is formed nearly in a rectangular shape inside the panel portion 14 to meet thereto. Hereinafter, the case where the fluorescent screen 13 is seen through the panel portion 14 as shown in FIG. 2 is referred to as screen.

Figure 3:
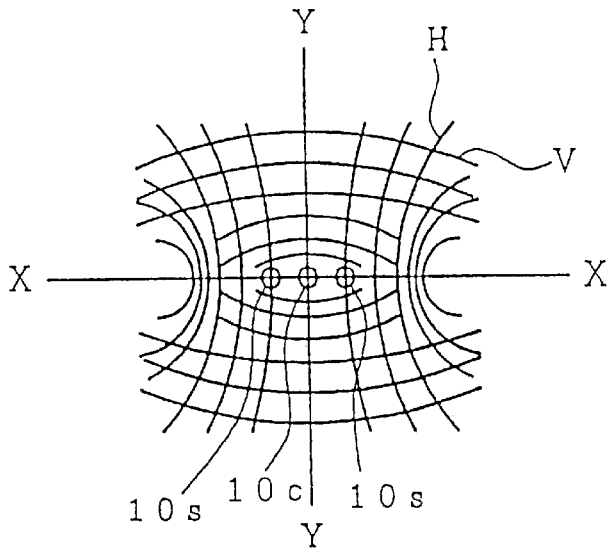
FIG. 3 (PRIOR ART)
FIG. 3 is a diagram illustrating a distribution of magnetic flux of a deflecting magnetic field in the color cathode-ray tube using three electron beams arranged in line.

The deflection yokes 11 generate an alternating magnetic field having a magnetic flux distribution as shown in FIG. 3, scans the direction of X—X axis in FIG. 2, scans the direction of Y—Y axis at a speed lower than that in the direction of X—X axis thereby to scan the entire fluorescent screen 13, and controls the amount of electron beam 10 from moment to moment in order to form a picture on the fluorescent screen 13 in compliance with the brightness distribution of emitted light. A locus of scanning in the direction of an axis X—X is called scanning line. The converging adjuster 42 corrects misconvergence and misimpingement of the three electron beams at the center of the screen.

In FIG. 3, symbol H denotes a magnetic flux for deflecting the electron beams toward the X—X direction in FIG. 2, and having a bobbin-shaped distribution. Hereinafter, this is referred to as a horizontally deflecting magnetic field. In FIG. 3, furthermore, symbol V denotes a magnetic flux for deflecting the electron beams toward the Y—Y direction in FIG. 2, and having a drum-shaped distribution. Hereinafter, this is referred to as a vertically deflecting magnetic field. Distributions of these magnetic fields are used for simplifying the circuit for controlling the convergence of three electron beams.

FIG. 2 illustrates a state where the fluorescent screen emits spot light on the screen of the color cathode-ray tube using three electron beams arranged in line. In FIG. 2, X—X represents a center axis of the screen in the horizontal direction, and Y—Y represents a center axis of the screen in the vertical direction. Reference numeral 15 denotes a spot at the center of the screen, having a vivid contour and a small diameter. A spot at the extreme right of the screen on the axis X—X consists of a highly bright portion 16 called core and a less bright portion 17 called halo existing above and below the core, the spot as a whole having a shape drawn in the horizontal direction. A spot at the upper end of the screen on the axis Y—Y consists of a core 18 which is crushed in the vertical direction and a halo 17.

The spots at the corners of the screen have a shape in which the halo 17 is superposed on the highly bright portion 19 with its core being crushed in the vertical direction and being drawn in the horizontal direction, the whole shape thereof being turned. Even the halo has a shape in which the content corresponding to 18 is superposed on the highly bright portion 16, and has the highest brightness and the greatest area in the screen.

On the screen of a practical color cathode-ray tube, the spots have different states depending upon the center of the screen and the periphery thereof as shown in FIG. 2; i.e., the resolution is lower in the periphery of the screen than in the central part of the screen. This phenomenon is called deflection error.

The vertically deflecting magnetic field V shown in FIG. 3 works to deflect the electron beams toward the vertical direction and to focus the electron beams in the vertical direction depending upon the angle of deflection. In FIG. 2, the core 18 is crushed in the vertical direction and halo 17 generates chiefly due to the vertically deflecting magnetic field V. At the picture position, the electron beam is focused in the vertical direction prior to arriving at the fluorescent screen. Similarly, the core 16 is drawn in the horizontal direction chiefly due to the action of the horizontally deflecting magnetic field H. In general, a drop in the resolution in the periphery of the screen is caused chiefly by the vertically deflecting magnetic field V.

Figure 4:
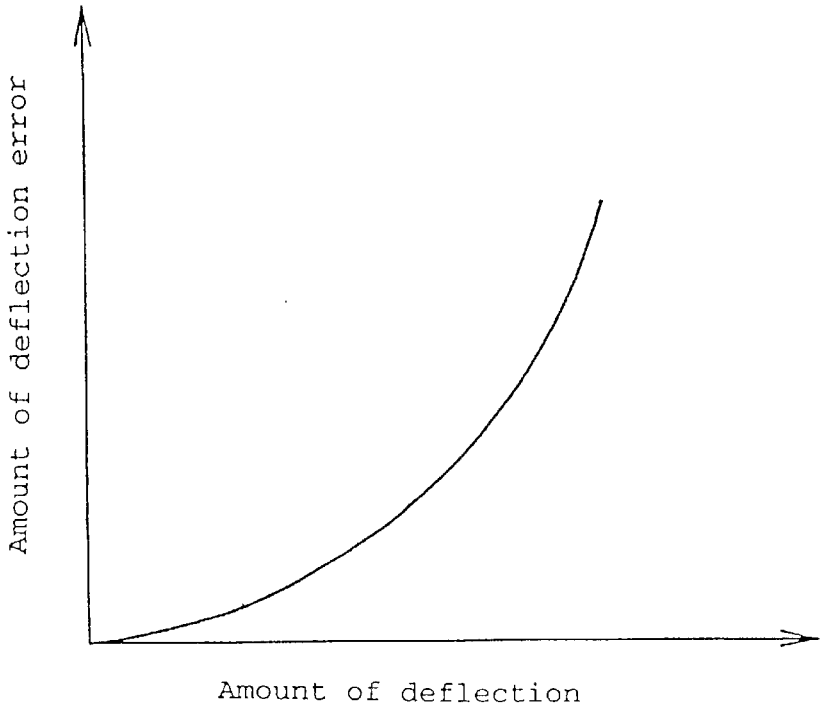
FIG. 4 (PRIOR ART)
FIG. 4 is a diagram illustrating a relationship between the amount of deflection and the amount of deflection error.

FIG. 4 is a diagram illustrating a relationship between the amount of deflection and the amount of deflection error. In the cathode-ray tube as shown in FIG. 4, the amount of deflection error increases abruptly with an increase in the amount of deflection.

Figure 5:
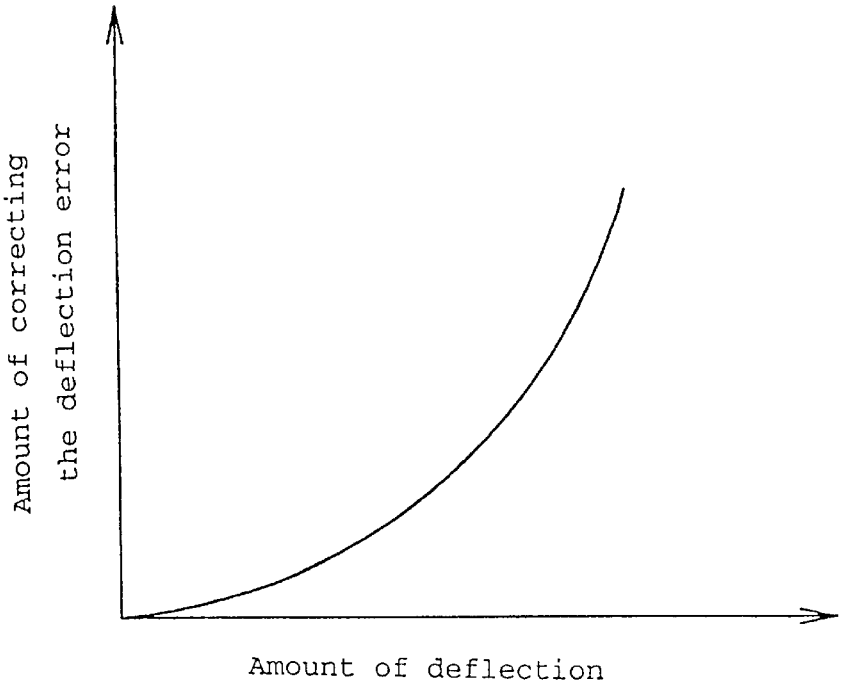
FIG. 5 is a diagram illustrating a relationship between the amount of deflection and the amount of correcting the deflection error.

FIG. 5 is a diagram illustrating a relationship between the amount of deflection and the amount of correcting the deflection error. According to the present invention, a fixed nonuniform electric field is formed in the deflecting magnetic field in the cathode-ray tube, and the deflection error is corrected depending upon the amount of deflection as shown.

Figure 6:
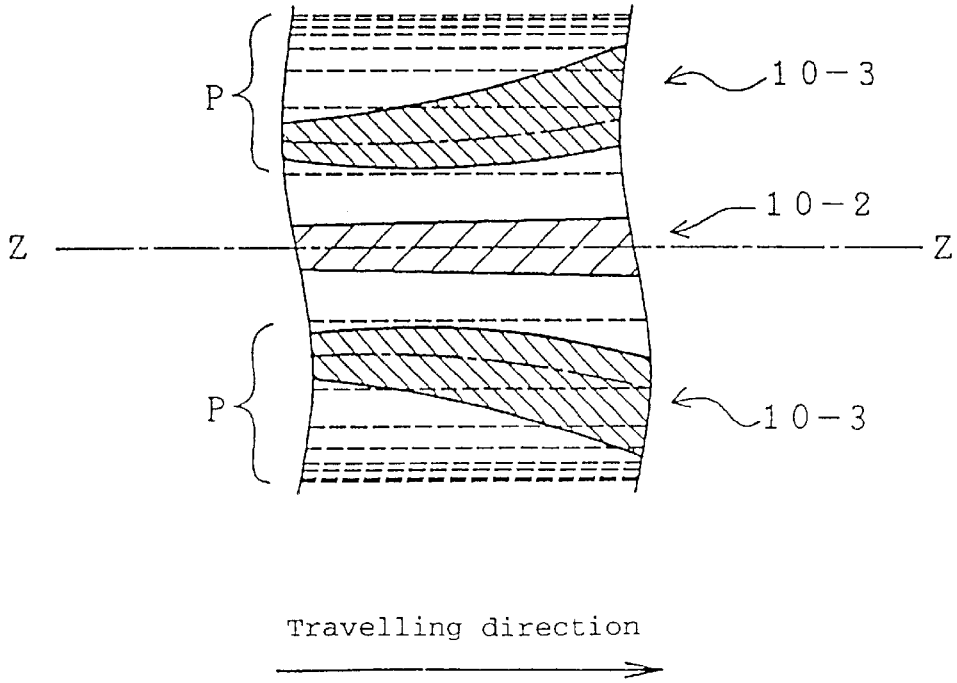
FIG. 6 is a diagram illustrating an astigmatic electric field which is an electric field for correcting the deflection error in the color cathode-ray tube according to an embodiment of the present invention.

FIG. 6 is a diagram illustrating an electric field for correcting the deflection error in the color cathode-ray tube according to an embodiment of the present invention, i.e., illustrating an astigmatic electric field which is the above-mentioned nonuniform electric field of when the deflection error is corrected depending upon the amount of deflection as shown in FIG. 5 by forming the fixed nonuniform electric field in the deflecting magnetic field in the cathode-ray tube.

The astigmatic electric field has two symmetrical planes that intersect at right angles. FIG. 6 illustrates a plane between the above-mentioned two symmetrical planes. In FIG. 6, broken lines P denote equipotential lines, and the gaps among them become narrow, the electric field becomes intense and the potential increases as they are away from the center axis Z—Z of the electric field.

Figure 10:
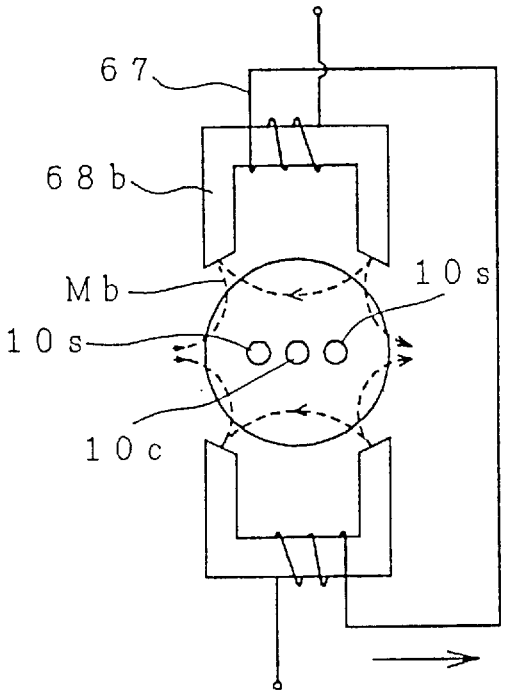
FIG. 10 is a diagram illustrating bobbin magnetic fields of U-shaped coils and an apparatus for forming the bobbin magnetic fields.

In FIG. 6, 10–2 denotes an electron beam having a trajectory near the center axis Z—Z of the electric field, the diameter of the electron beam slightly increasing as it travels through the electric field. Reference numeral 10–3 denotes electron beams having trajectories away from the center axis Z—Z of the electric field. Compared to the electron beam 10–2, their diameter abruptly increases and diverges as they travel through the electric field. The diameter increases progressively as they are away from the center axis Z—Z of the electric field, and the trajectories as a whole change toward directions to leave the center axis Z—Z of the electric field.

By forming a fixed electric field as shown in FIG. 6 in the deflecting magnetic field of the cathode-ray tube and by changing the trajectories of the electron beams by the deflecting magnetic field depending upon the amount of deflection like the electron beams 10–3, it is allowed to change the amount of divergence of the electron beams depending upon the amount of deflection.

Figure 7:
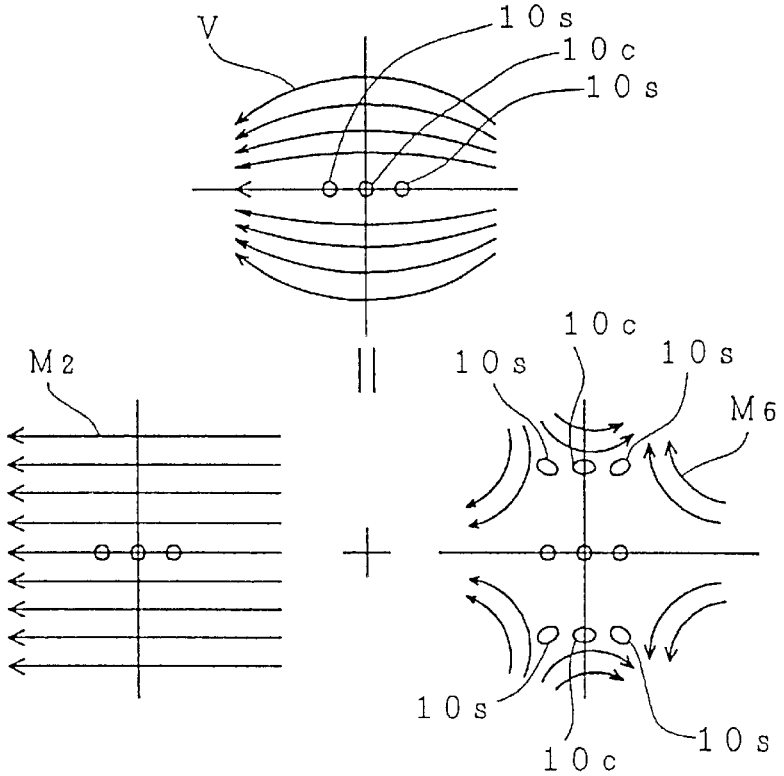
FIG. 7 is a diagram illustrating a magnetic field constitution in which the vertically deflecting magnetic field of the barrel type of FIG. 3 is separated into a symmetrical component (symmetrical dipole magnetic field) necessary for the deflection only and another component (negative hexapole magnetic field)

FIG. 7 is a diagram illustrating the constitution of a magnetic field in which the barrel-shaped vertically deflecting magnetic field V of FIG. 3 is divided into a symmetrical component (symmetrical dipole magnetic field $M_2$ necessary for the deflection only and another component (negative hexapole magnetic field $M_6$). What is necessary for the convergence control is the hexapole magnetic field $M_6$ in which the lines of magnetic force in tie horizontal direction have a negative sign.

Figure 8:
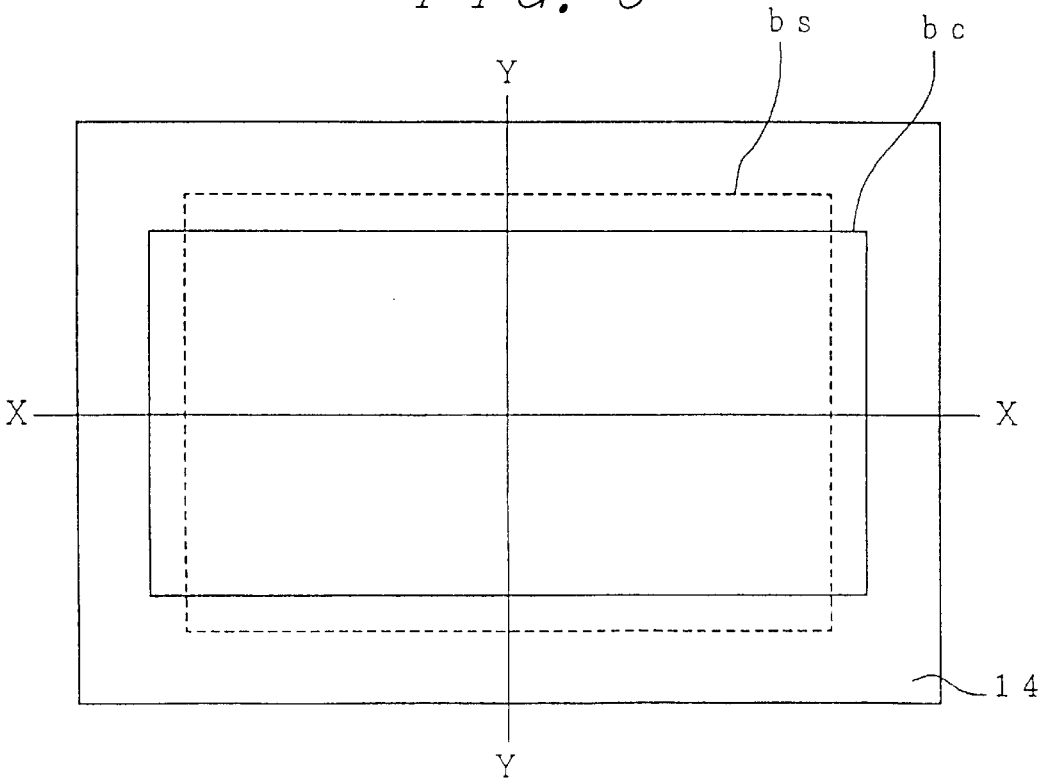
FIG. 8 is a diagram illustrating the light-emitting portions due to a scanning line relying upon the electron beam positioned at the center among the three electron beams and due to scanning lines relying upon the electron beams positioned on both sides of when the electric field as shown in FIG. 7 is used.

FIG. 8 is a diagram illustrating the light-emitting portions due to a scanning line based on the electron beam located at the center among the three electron beams and due to scanning lines based on the electron beams located on the sides of when the electric field shown in FIG. 7 is used.

In FIG. 8, bc denotes a light-emitting portion that corresponds to the electron beam located at the center. The light-emitting portion bs creates a misconvergence which is longer in the horizontal direction than, and is shorter in the vertical direction than, the light-emitting portion bs that corresponds to the electron beams located on the sides. The light-emitting porion bc greatly deteriorates the quality of the displayed picture. As shown in FIG. 7, furthermore, the electron beams 10*s* located on the sides are rotated and distorted over and under the screen due to the hexapole magnetic component $M_6$ as shown in FIG. 7, whereby difference takes place in the vertical diameter relative to the electron beam 10*c* located at the center, and the picture quality is deteriorated. These states are referred to as coma due to the deflecting yoke.

Figure 9:
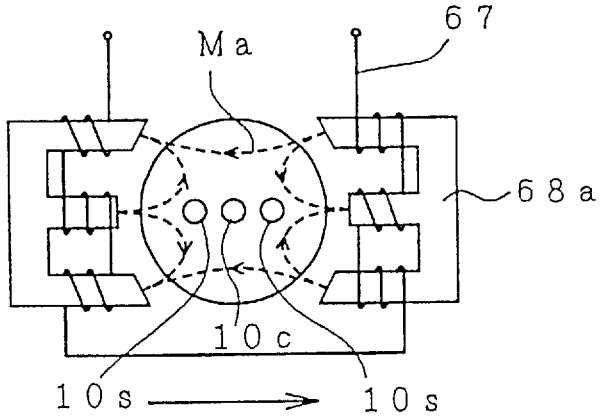
FIG. 9 is a diagram illustrating bobbin magnetic fields of E-shaped coils and an apparatus for forming the bobbin magnetic fields.

FIG. 9 is a diagram illustrating a bobbin magnetic field produced by E-shaped coils and a device for producing the bobbin magnetic field, and FIG. 10 is a diagram illustrating a bobbin magnetic field produced by U-shaped coils and a device for producing the bobbin magnetic field. Coils 67 are wound on the cores 68*a* and 68*b*, and an electric current is supplied from an external unit to the coils 67, whereby auxiliary magnetic fields Ma and Mb are formed to correct coma caused by the deflecting yoke and to correct misconvergence mentioned earlier. The devices for forming the bobbin magnetic field comprise a plurality of parts such as coils 67, cores 68*a*, 68*b*, etc., and are usually mounted on the deflecting yokes. With such a plurality of parts being attached to the deflecting yokes, however, production of the deflecting yokes becomes expensive which is far from realistic from the standpoint of manufacturing the cathode-ray tubes and picture display devices which must be highly competitive in the markets.

Figure 11:
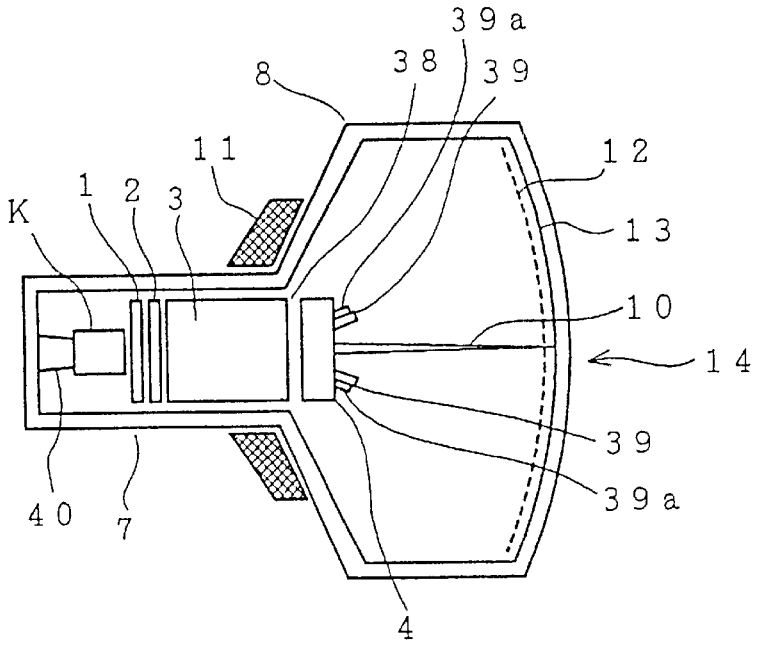
FIG. 11 is a diagram schematically illustrating the constitution of a color cathode-ray tube according to an embodiment of the present invention.

FIG. 11 is a diagram schematically illustrating the constitution of the color cathode-ray tube according to an embodiment of the present invention, wherein reference numeral 1 denotes a first electrode, 2 denotes a second electrode, 3 denotes a third electrode, 4 denotes a fourth electrode, 39 denotes deflection error correction electrodes, 39*a* denotes magnetic materials for correcting the magnetic field installed on the deflection error correction electrodes 39, reference numeral 40 denotes a stem lead, and symbol K denotes a cathode.

In FIG. 11, the deflection error correction electrodes 39 are installed on the fourth electrode 4 on the side of the fluorescent screen 13, the fourth electrode 4 being positioned in the deflecting magnetic field formed by the deflecting yokes 11 and serving as an anode of the electron gun.

On the deflection error correction electrodes 39 are installed magnetic materials 39*a* on at least the portions corresponding to the side electron beams; i.e., a total of two magnetic materials 39*a* are electrically connected to, and mechanically secured to, the fourth electrode 4 up and down in the vertical direction of the electron beam 10.

The magnetic materials 39*a* are small pieces made of a ferromagnetic material such as ferrite or a nickel alloy and are provided on the back surfaces of the deflection error correction electrodes 39 between which the side electron beams are sandwiched, thereby to constitute a deflecting magnetic field correction member (field controller).

Figure 12A:
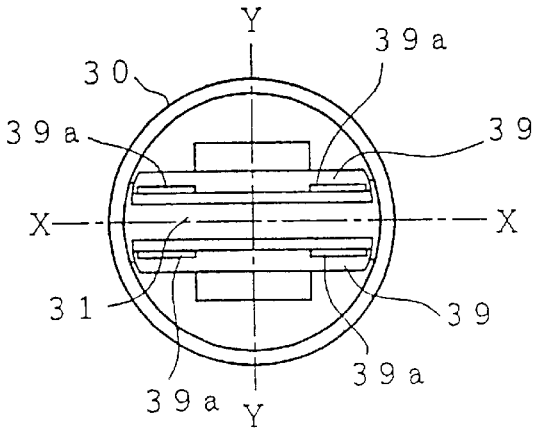
FIG. 12 is a diagram illustrating the shape of an electrode for correcting the deflection error according to the present invention and, particularly, illustrating an example of installing magnetic materials for correcting the magnetic field.
Figure 12B:
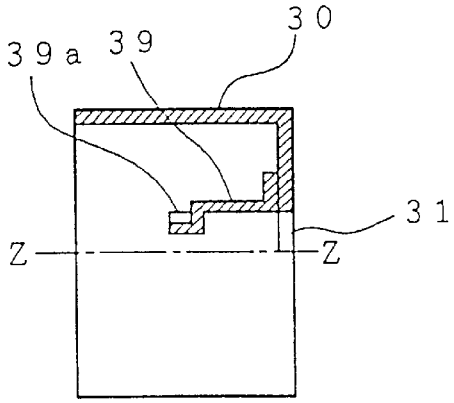

FIG. 12 illustrates the shape of the deflection error correction electrodes according to the present invention and, particularly, illustrates installation of the magnetic materials for correcting the magnetic field, wherein the diagram (a) is a front view as viewed from the side of the fluorescent screen and the diagram (b) is a sectional side view illustrating part of the diagram (a).

In this example, inside a cup-shaped screen electrode 30 connected to the fourth electrode which serves as the anode of the electron gun on the side of the fluorescent screen, there are installed magnetic materials 39*a* on the back surfaces of the side electron beams of the deflection error correction electrodes 39 that are secured at positions in parallel with the in-line direction to sandwich the electron beam therebetween in the vertical direction.

Figure 13A:
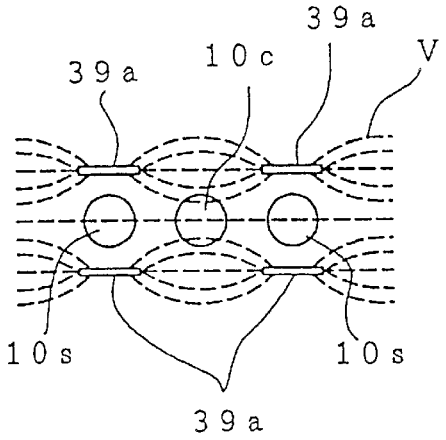
FIG. 13 is a diagram schematically illustrating the action for correcting the deflecting magnetic field using the magnetic materials of FIG. 12.
Figure 13B:
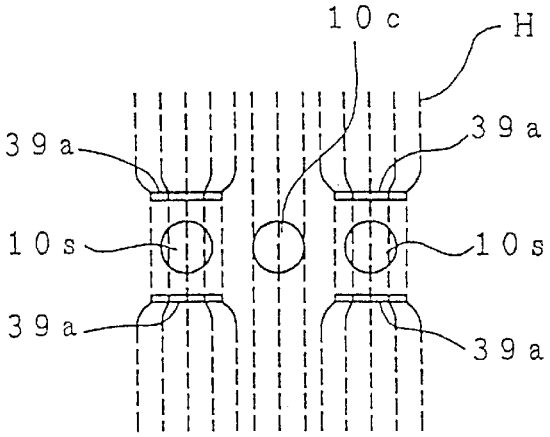

FIG. 13 is a diagram schematically illustrating the action for correcting the deflecting magnetic field using the magnetic materials of FIG. 12, wherein the diagram (a) illustrates the action for the vertically deflecting magnetic field and the diagram (b) illustrates the action for the horizontally deflecting magnetic field.

Referring to the diagram (a), the vertically deflecting magnetic field v weakly acts upon the side electron beams 10*s* but strongly acts upon the center electron beam 10*c*.

Referring to the diagram (b), furthermore, the horizontally deflecting magnetic field H strongly acts upon the side electron beams 10*s* but weakly acts upon the center electron beam 10*c*.

As described above, provision of the magnetic materials 39*a* on the deflection error correction electrodes 39 makes it possible to decrease coma caused by the deflecting magnetic field.

The deflecting magnetic field infiltrates even into the main lens of the electron gun. Therefore, the electrodes which are close to the fluorescent screen rather than to the main lens must be so constructed that the electron beams will not impinge thereupon. According to the present invention, the electron gun which has a plurality of electrodes and uses three electron beams arranged in line, is best designed in a manner that the aperture of the screen electrode 30 through which the three electron beams pass is a single hole 31 without partitions permitting the passage of three electron beams in common and that the deflecting error correction electrodes 39 are installed on the side of the fluorescent screen rather than the side of the electron beam passage aperture 31 in the bottom surface of the screen electrode 30.

Figure 14A:
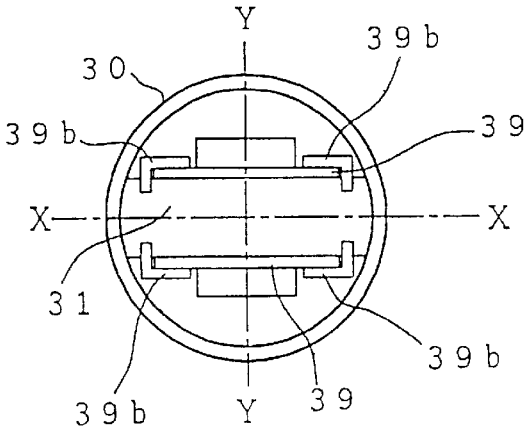
FIG. 14 is a diagram illustrating another shape of the electrode for correcting the deflection error according to the present invention and, particularly, illustrating another example of installing the magnetic materials for correcting the magnetic field.
Figure 14B:
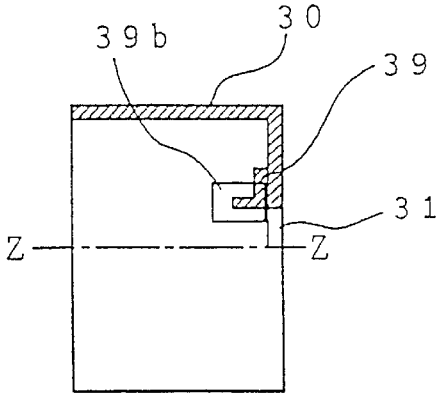

FIG. 14 illustrates another shape of the deflection error correction electrodes according to the present invention and, particularly, illustrates another example of installing the magnetic materials for correcting the magnetic field, wherein the diagram (a) is a front view as viewed from the side of the fluorescent screen and the diagram (b) is a sectional side view illustrating part of the diagram (a).

In FIG. 14, the magnetic material 39*b* is constituted by a first plate portion which is nearly in parallel with the in-line direction and has nearly a rectangular shape, and a second plate portion which is formed integrally with the first plate portion, folded toward the side of the in-line center axis (X—X) and has a nearly rectangular surface which is nearly vertical to the in-line direction. The first plate portion is secured at such a position as to sandwich the side electron beams from a direction at right angles with the in-line direction, and the second plate is secured at such a position that the end thereof is opposed to the side electron beams on the side opposite to the center electron beam.

Figure 15A:
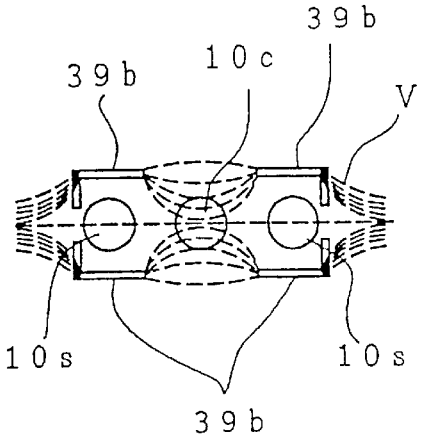
FIG. 15 is a diagram schematically illustrating the action for correcting the deflecting magnetic field by using the magnetic materials of FIG. 14.
Figure 15B:
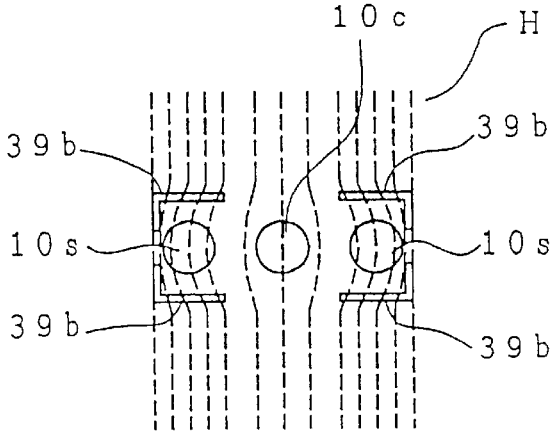

FIG. 15 is a diagram schematically illustrating the action for correcting the deflecting magnetic field by using the magnetic materials of FIG. 14, wherein the diagram (a) illustrates the action upon the vertically deflecting magnetic field and the diagram (b) illustrates the action upon the horizontally deflecting magnetic field. Referring to the diagram (a), the second plate portion of the magnetic material 39*b* illustrated in FIG. 14 that is folded nearly at right angles toward the in-line center axis, is provided on the outside of the side electron beam portions. In this case, the vertically deflecting magnetic field V distributed near the in-line center axis is concentrated onto the second plate portion more densely than that of FIG. 13(*a*), the action becomes more weak upon the side electron beams 10*s* and the action becomes stronger upon the center electron beam 10*c*. Furthermore, the second plate portion works to shield the negative hexapole magnetic field component in the vertically deflecting magnetic field shown in FIG. 7 from acting on the outside portions of the side electron beams 10*s*. Therefore, rotational distortion of the side electron beams 10*s* decreases at the upper and lower portions of the screen, and the difference in the vertical diameter becomes small relative to the center electron beam 10*c*.

As shown in FIG. 15(*b*), furthermore, the horizontally deflecting magnetic field H is densely concentrated near the second plate portion of the magnetic material 39*b*, and acts stronger upon the side electron beams 10*s* than that shown in FIG. 13(*b*) and acts more weakly upon the center electron beam 10*c*.

Figure 16A:
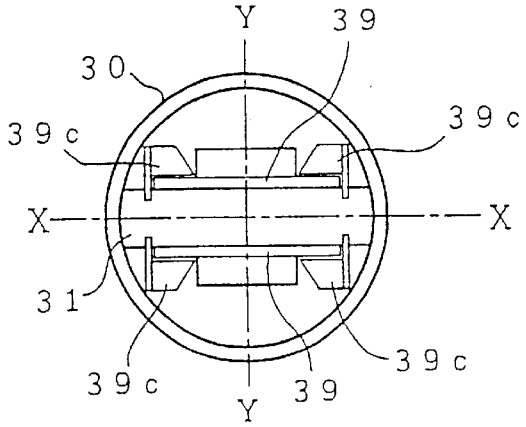
FIG. 16 is a diagram illustrating a further shape of the electrode for correcting the deflection error according to the present invention and, particularly, illustrating a further example of installing the magnetic materials for correcting the magnetic field.
Figure 16B:
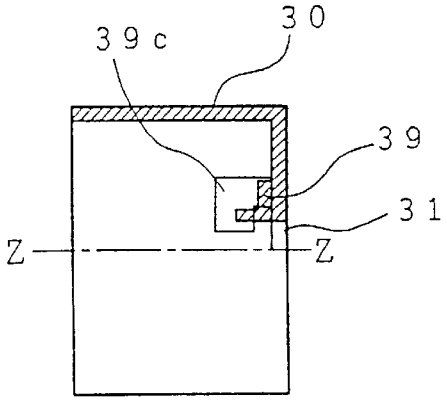

FIG. 16 shows a further shape of the deflection error correction electrodes according to the present invention and, particularly, illustrates a further example of installing the magnetic materials for correcting the magnetic field, wherein the diagram (a) is a front view as viewed from the side of the fluorescent screen and the diagram (b) is a sectional side view illustrating part of the diagram (a).

In FIG. 16, the magnetic material 39*c* has a third plate portion having a trapezoidal surface which is nearly perpendicular to the direction of the tubular axis (Z—Z) at a position to sandwich the side electron beam portions in a direction at right angles with the in-line direction, and a second plate portion having nearly a rectangular surface nearly perpendicular to the in-line direction on the side of the side electron beam portions opposite to the center electron beam portion, the second plate portion being formed integrally with the third plate portion and being folded toward the direction of tubular axis (Z—Z) so that its end is opposed thereto.

In FIG. 16, the vertically deflecting magnetic field V acts more strongly upon the center electron beam 10*c* and the horizontally deflecting magnetic field H acts more strongly upon the side electron beams 10*s* than those shown in FIG. 15, and coma is further corrected by the deflecting magnetic field.

Figure 17B:
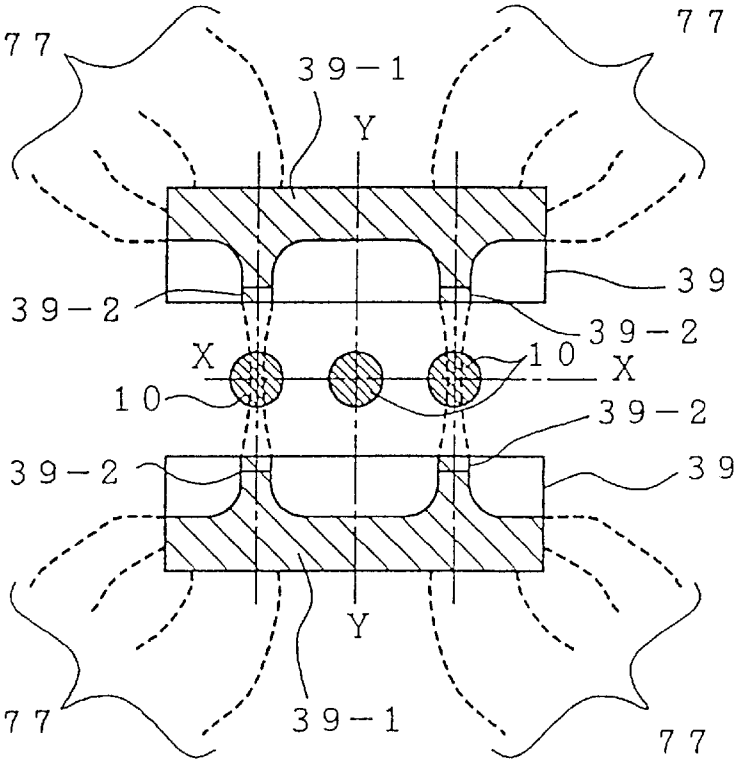
FIG. 17 is a diagram illustrating a still further shape of the electrode for correcting the deflection error according to the present invention.
Figure 17A:
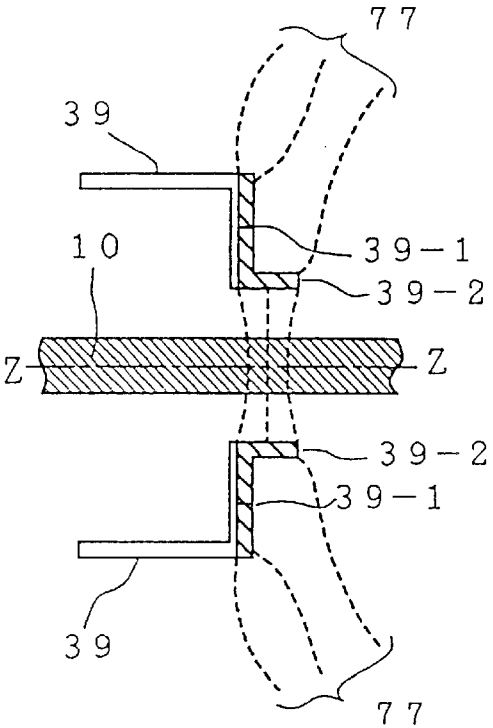

FIG. 17 shows a still further shape of the deflection error correction electrodes according to the present invention, wherein the diagram (a) is a side view and the diagram (b) is a front view as viewed from the side of the fluorescent screen.

In FIG. 17, reference numeral 77 denotes lines of magnetic force for deflecting the electron beams 10 toward the in-line direction, and the magnetic material 39–1 is used as part of the deflection error correction electrode 39. Besides, the opposing ends 39–2 protrude toward the fluorescent screen in the direction Z—Z only at portions opposed to the side electron beams. This makes it possible to collect lines of magnetic force 77 near the side electron beams to promote the deflecting action at such portions, in order to correct the coma.

In order that the effect for correcting the deflection error is exhibited in the region of nonuniform electric field, it is essential that the deflecting magnetic field has a required amount of magnetic flux density.

In FIG. 17, at least part of the deflection error correction electrode is constituted by using a magnetic material, and serves as means for increasing the magnetic flux density in the electric field region making it possible to more favorably correct the deflection error.

Owing to the action of the deflection error correction electrodes 39, the fixed astigmatic electric field as explained with reference to FIG. 6 is formed in the deflecting magnetic field in the cathode-ray tube to correct the deflection error in the cathode-ray tube and to improve uniformity in the resolution over the whole screen. Moreover, the main lens 38 is permitted to be disposed near the fluorescent screen 13, making it possible to improve resolution at the center of the screen and to shorten the overall length without increasing a maximum deflecting angle in the cathode-ray tube.

Moreover, the magnetic materials 39*a*, 39*b* and 39*c* correct the amount affected by the deflecting magnetic field, whereby the coma decreases and the picture of a high quality is reproduced.

By using the above-mentioned cathode-ray tube, it is allowed to provide a picture display device of a high picture quality featuring shortened depth of the cabinet and eliminating color deviation on the displayed picture.

The mechanism of action of the present invention will now be described.

Figure 18:
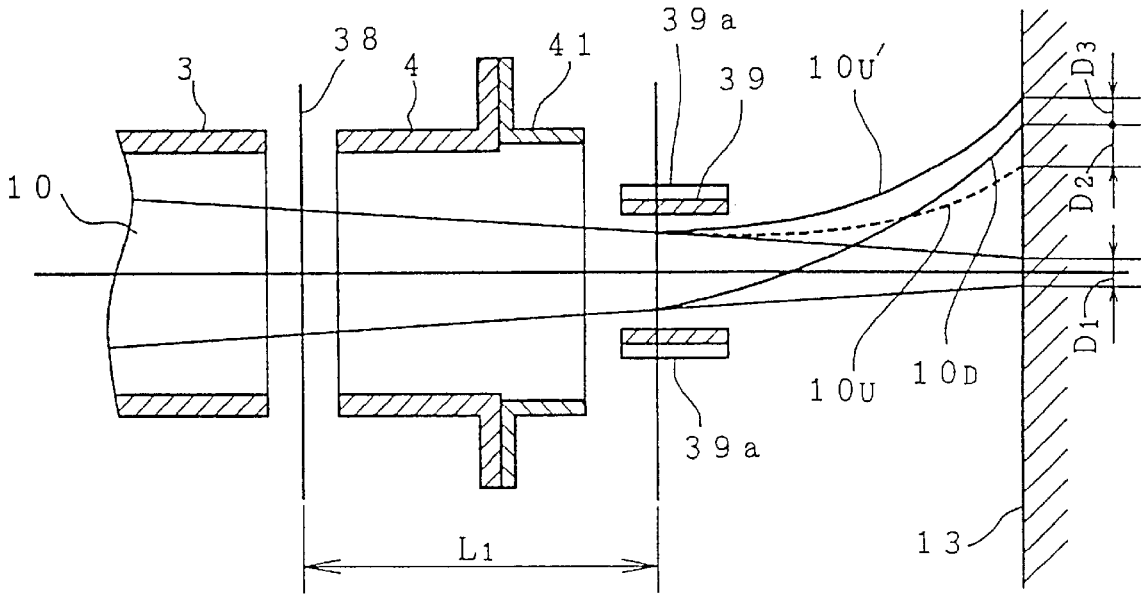
FIG. 18 is a diagram illustrating the action of an electron gun in the color cathode-ray tube according to an embodiment of the present invention.

FIG. 18 is a diagram illustrating the action of an electron gun in the color cathode-ray tube according to an embodiment of the present invention, wherein deflection error correction electrodes 39 equipped with magnetic materials 39*a* are installed in the deflecting magnetic field between the fourth electrodes 4 and 41 constituting an anode of the electron gun and the fluorescent screen.

The deflection error correction electrodes 39 are constituted of two portions opposed to each other with the passage of electron beam sandwiched therebetween, and are maintained at an anode potential being connected to the fourth electrode 41 which is the anode. Owing to this arrangement, the electric field shown in FIG. 6 is formed between the above-mentioned opposing portions in relation to an electric field of the main lens 38 that permeates through the interior of the anode of the electron gun.

When the electron beams 10 are not deflected, a spot of a diameter $D_1$ is formed at the center of the fluorescent screen through the central part of the above-mentioned opposing portions. When the electron beams 10 are deflected toward an upper part of the fluorescent screen, a spot of a diameter $D_3$ is formed on the upper part of the fluorescent screen along a trajectory represented by envelopes $\mathbf{10}_D$ and $\mathbf{10}_U$, passing through a portion higher than the central part of the opposing portions.

Figure 19:
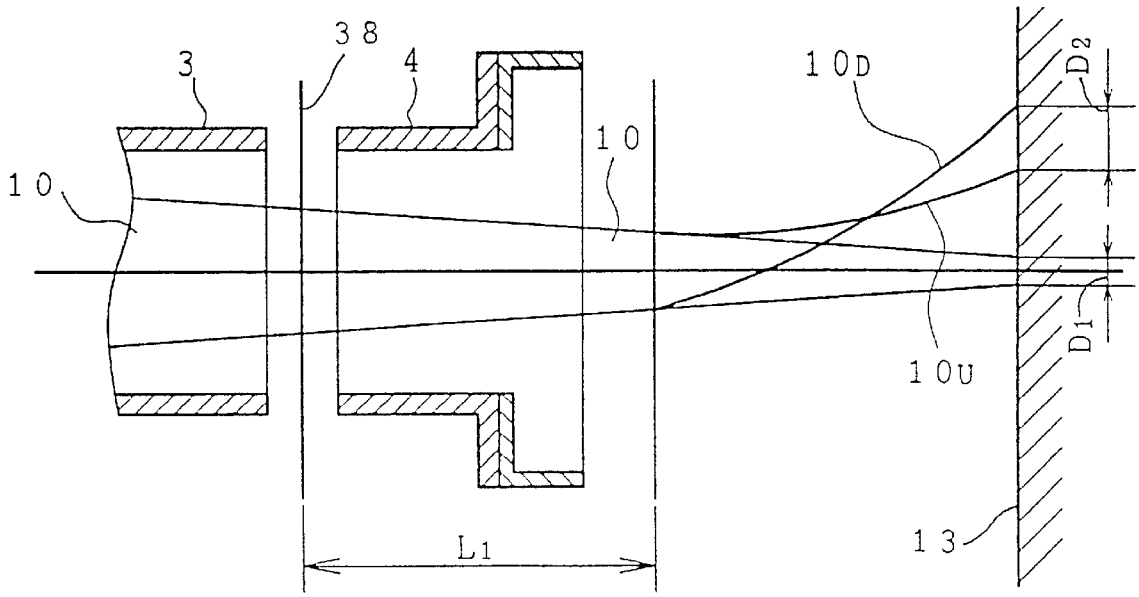
FIG. 19 (PRIOR ART)
FIG. 19 is a diagram illustrating the same electron gun as that of FIG. 14 but with no electrode for correcting the deflection error.

FIG. 19 is a diagram illustrating the action of when the electron gun same as that of FIG. 18 is not provided with the deflection error correction electrodes. In the case of FIG. 19 without the deflection error correction electrodes 39, the envelope $\mathbf{10}_U$, of FIG. 18 becomes as represented by a trajectory shown in FIG. 19 due to the focusing action of the vertically deflecting magnetic field, and intersects the envelope $\mathbf{10}_D$ before it arrives at the fluorescent screen 13. The electron beam is focused excessively, and a spot of a diameter $D_2$ is formed on the fluorescent screen. In this state, halo occurs over and under the cores 18 and 19 in FIG. 2, resulting in a decrease in the resolution.

In FIG. 18, the focusing action of the vertically deflecting magnetic field is canceled depending upon the amount of deflection by the action of a fixed divergent electric field having astigmatism created by the deflection error correction electrodes 39, and the deflection error is corrected depending upon the amount of deflection. At this moment, the coma is corrected, too, by the magnetic materials 39*a*.

Figure 20:
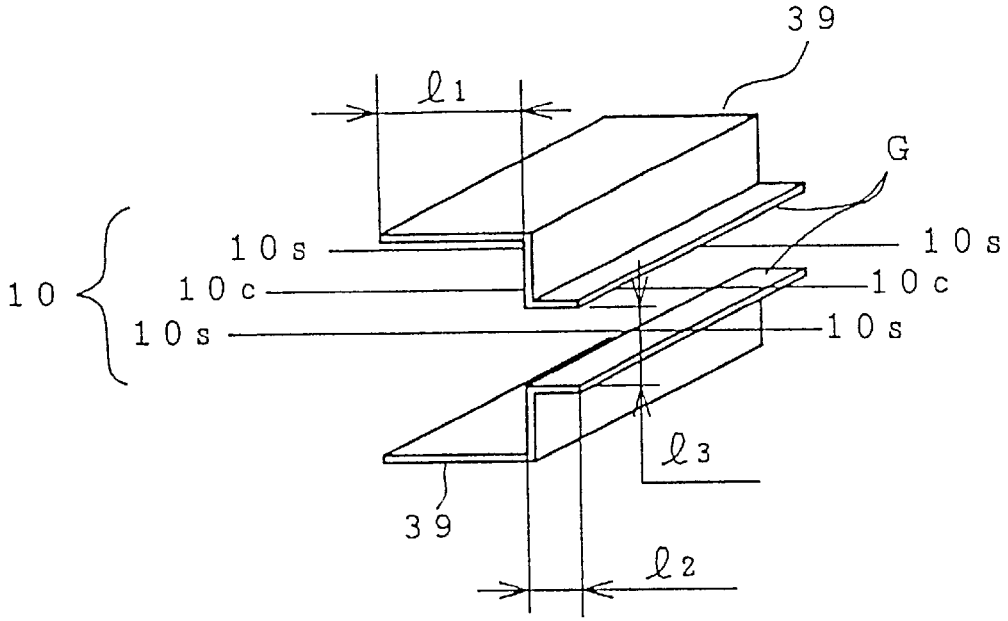
FIG. 20 is a diagram illustrating the shape of an electrode for correcting the deflection error of when no magnetic material is installed.

FIG. 20 is a diagram illustrating the shape of deflection error correction electrodes without having magnetic materials. The deflection error correction electrodes 39 are constituted by two parts having portions folded in two stages which are opposed to each other in a manner that the three electron beams 10 (center electron beam 10*c*, side electron beams 10*s*) arranged in line pass through the opposing portions.

In FIG. 20, the deflection error correction electrodes 39 are brought on their right side on the paper close to the fluorescent screen and are installed on their left side at a position away from. the fluorescent screen. The potential to be applied thereto may be different from that applied to the electron gun. The lengths $l_1$, $l_2$ in the direction of the tubular axis, the gap $l_3$ of the opposing portion on the side of the fluorescent screen, and the position of installation are not definitely determined since they may vary depending upon the characteristics of the electron gun that is employed, structure of the cathode-ray tube, conditions for driving the cathode-ray tube, and the object of using the cathode-ray tube. Portions G opposed to each other maintaining a narrow gap may not be parallel flat plates.

Figure 21:
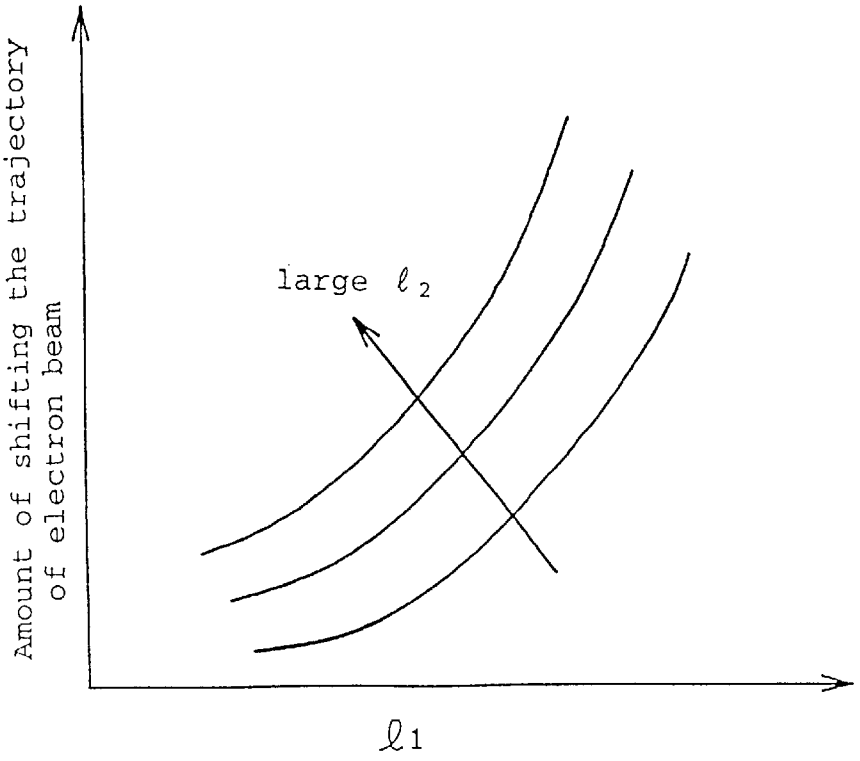
FIG. 21 is a diagram illustrating a relationship between the length of portions opposed to each other maintaining a wide gap in the direction at right angles with the in-line direction in FIG. 20 and the amount of shifting the trajectories of electron beams that have entered into the electric field being deviated from the center of the electric field of FIG. 6.

FIG. 21 is a diagram illustrating a relationship between the length $l_1$ of portions opposed to each other maintaining a wide gap in the direction at right angles with the in-line direction in FIG. 20 and the amount of shifting the trajectory of electron beam 10–3 that has entered into the electric field being deviated from the center of the electric field in FIG. 6, with the length $l_2$ of portions opposed to each other maintaining a narrow gap in the direction at right angles with the in-line direction in FIG. 20 as a parameter.

As shown in FIG. 21, the amount of shifting the trajectory of the electron beam suddenly increases with an increase in $l_1$. The length $l_2$ increases in a similar manner. Therefore, the amount of deflection can be changed to some extent by changing $l_1$ and/or $l_2$ depending upon the portions corresponding to the center electron beam and to the side electron beams among the three electron beams arranged in line.

Figure 22:
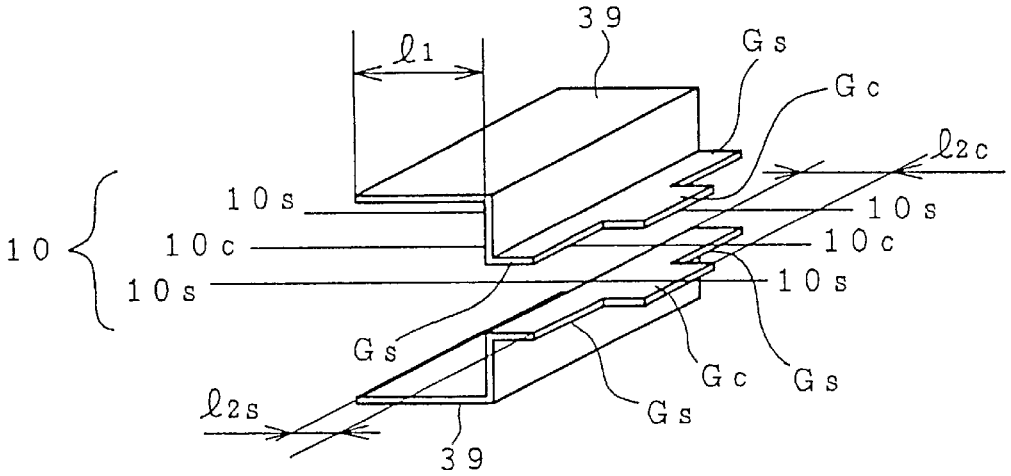
FIG. 22 is a diagram illustrating a yet further shape of the electrode for correcting the deflection error according to the present invention.

FIG. 22 is a diagram illustrating a yet further shape of the deflection error correction electrodes according to the present invention. Among the portions of the deflection error correction electrodes 39 opposed to each other maintaining a narrow gap, portions Gs corresponding to the side electron beams 10*s* have a length $l_{2S}$ shorter than a length $l_{2C}$ of a portion Gc corresponding to the center electron beam 10*c*, in order to correct misconvergence in the vertical direction in FIG. 8.

Figure 23A:
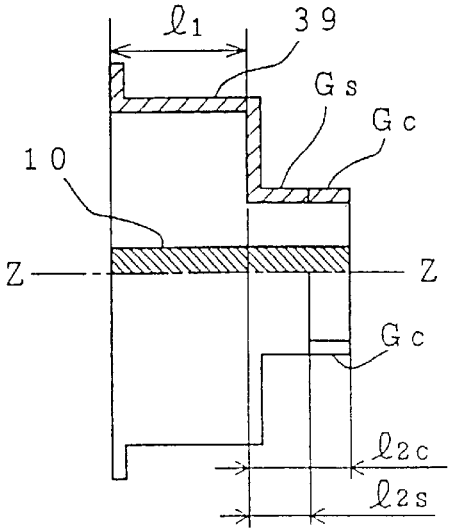
FIG. 23 is a diagram illustrating a further shape of the electrode for correcting the deflection error according to the present invention.
Figure 23B:
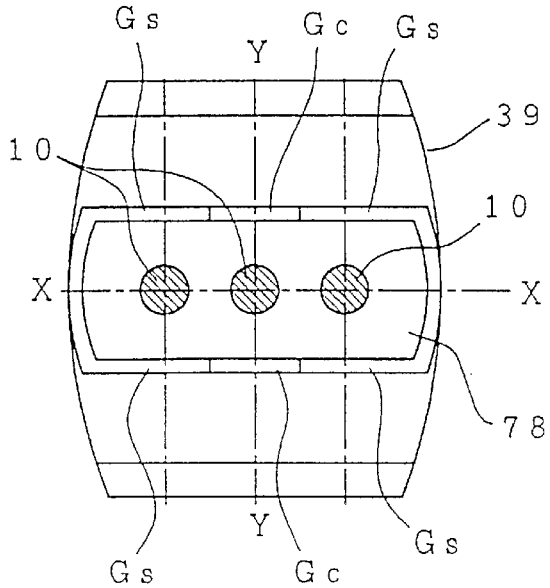

FIG. 23 is a diagram illustrating another shape of the deflection error correction electrode according to the present invention, wherein the diagram (a) is a side sectional view illustrating major portions and the diagram (b) is a front view as viewed from the side of the fluorescent screen.

In FIG. 23, the deflection error correction electrodes 39 are constituted by cylinders having two stages of nearly rectangular cross sections of different diameters, which are so arranged that the three electron beams 10 in line pass through the inside of the opening portion 78. In other respects, the constitution is the same as that of FIG. 22.

Figure 31:
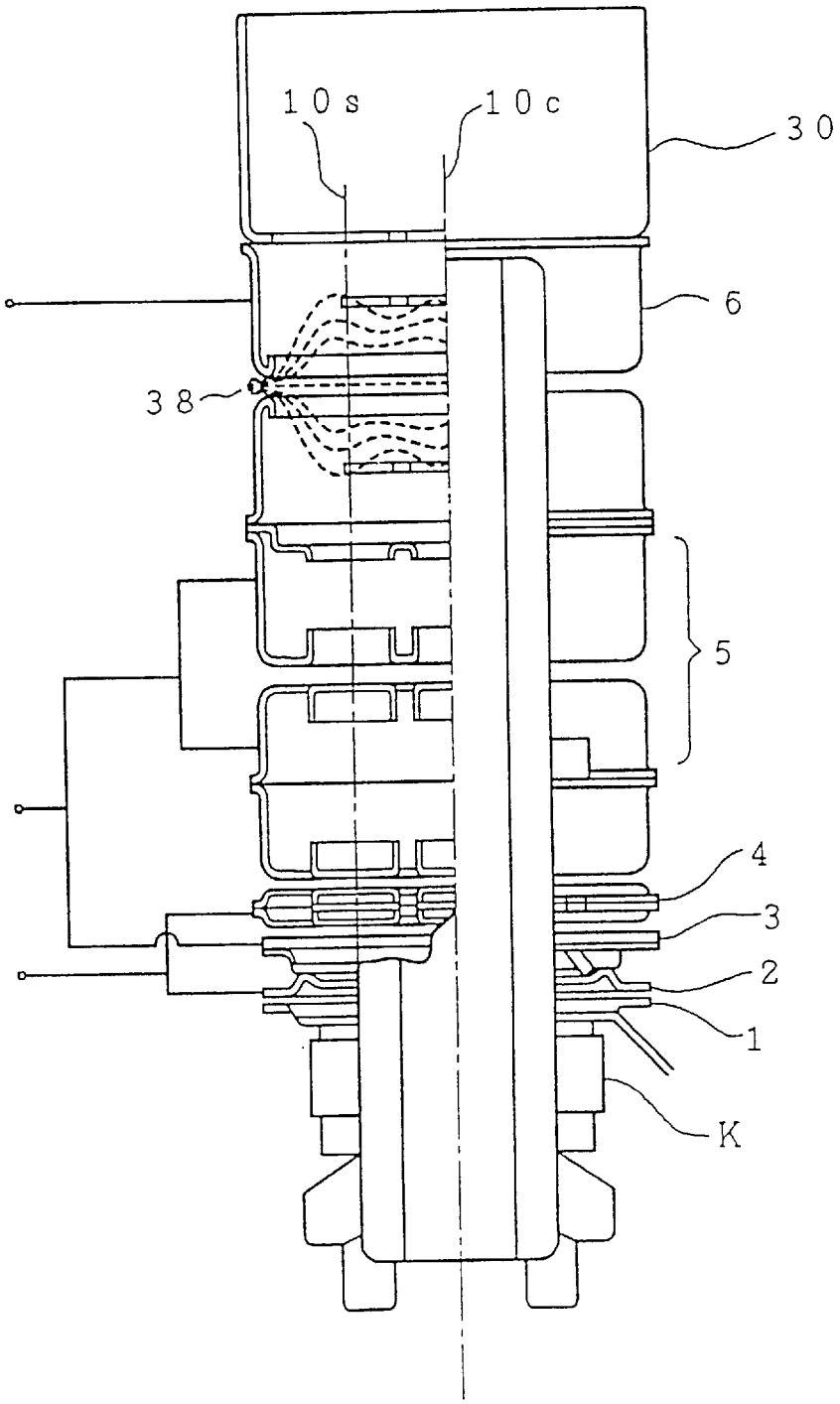
FIG. 31 (PRIOR ART)
FIG. 31 is a sectional view illustrating a portion of an electron gun for the color cathode-ray tube using three electron beams arranged in line.
Figure 32A:
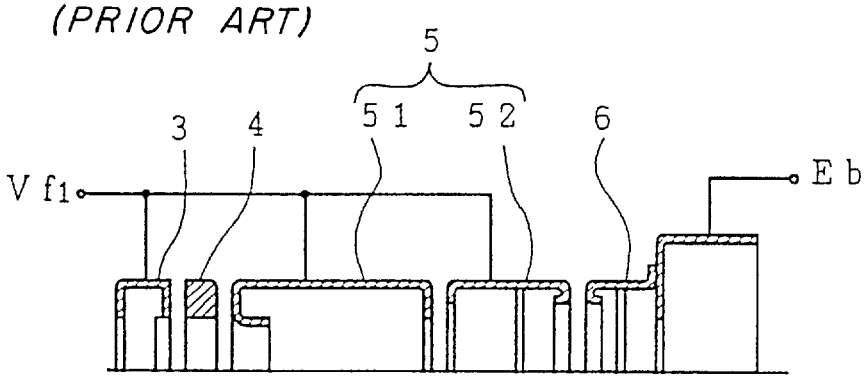
FIG. 32(a) (PRIOR ART)
FIG. 32 is a sectional view schematically illustrating major portions for comparing the structure of electron guns depending upon the manner of applying a focusing voltage.
Figure 32B:
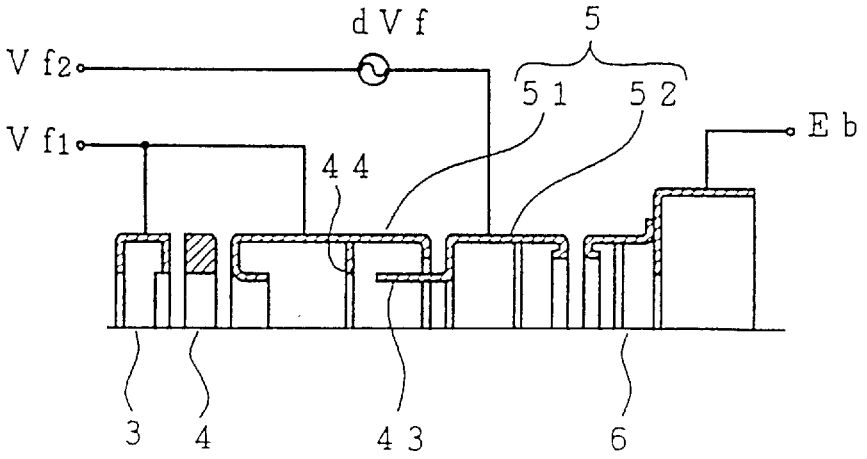
FIG. 32(b) (PRIOR ART)
Figure 33A:
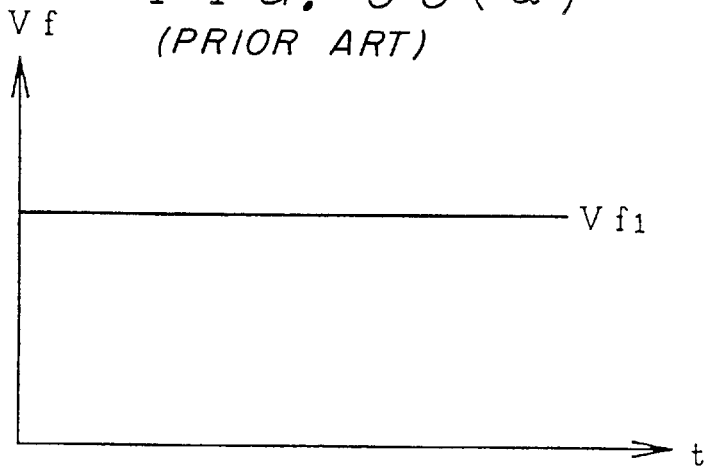
FIG. 33(a) (PRIOR ART)
FIG. 33 is a diagram illustrating a focusing voltage to be applied to the electron gun shown in FIG. 32.
Figure 33B:
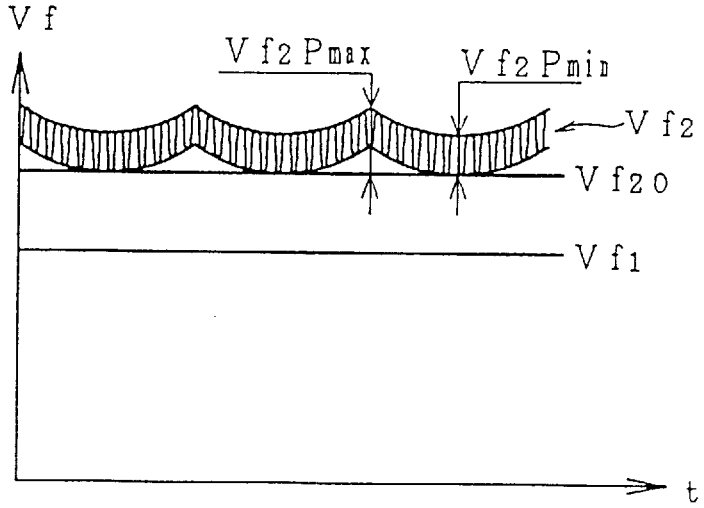
FIG. 33(b) (PRIOR ART)

In FIGS. 3 and 31, the two electron beams 10*s* located aside pass through the regions of different flux distributions depending upon when they are deflected toward the right or toward the left, and receive different action from the deflecting magnetic field. When the deflection error in the horizontal direction is corrected depending upon the amount of deflection by forming a fixed nonuniform electric field in the deflecting magnetic field in the color cathode-ray tube which uses three electron beams arranged in line, the amount of correcting the deflection error of the two electron beams 10*s* located aside is changed depending upon the direction of deflection in order to further uniformize the resolution over the whole screen.

Figure 24:
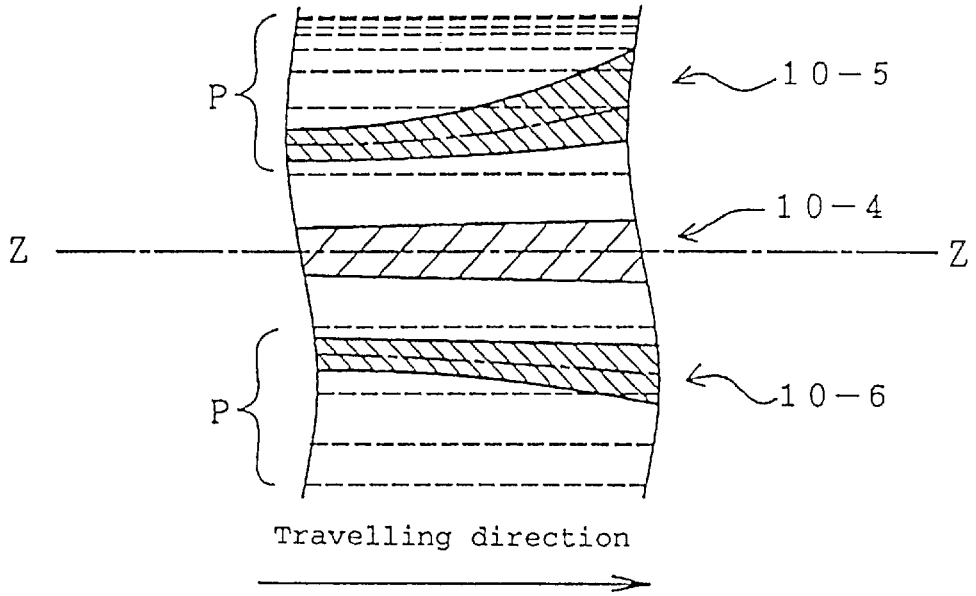
FIG. 24 is a diagram illustrating a coma electric field which is a fixed nonuniform electric field formed in the deflecting magnetic field according to another embodiment of the present invention.

FIG. 24 is a diagram illustrating a coma electric field which is a fixed nonuniform electric field formed in the deflecting magnetic field according to another embodiment of the present invention.

The coma electric field has a symmetrical plane, and FIG. 24 illustrates a state on the symmetrical plane.

In FIG. 24, the distance among the equipotential lines P becomes narrow as they are away from the center axis Z—Z of the electric field, and the electric field becomes intense and the potential increases. In a portion under the axis Z—Z on the surface of the paper, the distance among the equipotential lines P becomes less narrow than in the upper portion. The electron beam 10–4 passing near the axis Z—Z slightly diverges as it travels through the electric field, and its diameter increases slightly. The electron beam that takes a trajectory away from the axis Z—Z diverges as it travels through the electric field to increase its diameter and, besides, the trajectory as a whole is away from the axis Z—Z. The electron beam 10–5 passing over the axis Z—Z diverges more than the electron beam 10–6 passing under the axis Z—Z, and the trajectory as a whole is far away from the axis Z—Z.

According to the present invention, the fixed electric field having a distribution as shown in FIG. 24 is formed in the magnetic field for deflecting the electron beams 10*s* located aside of the electron gun shown in FIG. 31, in order to correct the deflecting error depending upon the direction of horizontal aberration and the amount of deflection.

Figure 25A:
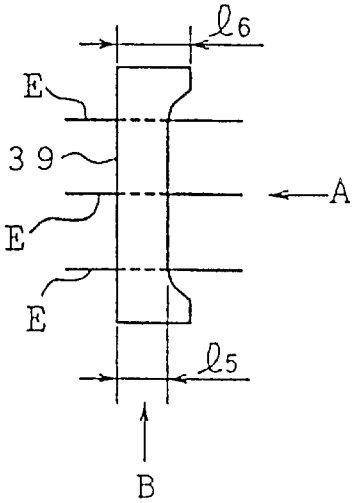
FIG. 25 is a diagram illustrating another shape of the electrode for correcting the deflection error according to the present invention.
Figure 25B:
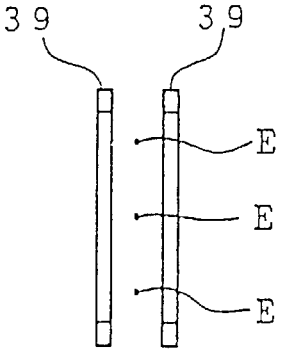
Figure 25C:
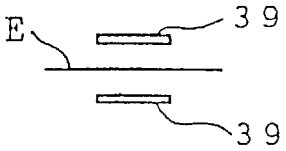

FIG. 25 is a diagram illustrating another shape of the deflection error correction electrodes according to the present invention, wherein the diagram (a) is a top view, the diagram (b) is a front view as viewed from the direction of an arrow A, and the diagram (c) is a side view as viewed from the direction of an arrow B.

In FIG. 25, the deflection error correction electrodes 39 are constituted by two flat parts having partly different lengths which are opposed to each other in a manner that the three electron beams arranged in line pass through the opposing portions.

In FIG. 25, furthermore, the deflection error correction electrodes 39 are so arranged that the right sides on the surface of the paper are brought close to the fluorescent screen and the left sides are located away from the fluorescent screen. Symbol E denotes center trajectories of the three electron beams arranged in line which have not been deflected. When the electron beams are deflected toward the in-line direction in the diagram (a), the electron beam positioned at the center receives the same action irrespective of whether it is deflected upwardly or downwardly on the surface of the paper since the deflection error correction electrodes 39 have a symmetrical shape. Concerning the electron beams located aside, the deflection error correction electrode 39 has a length $l_5$ on the side close to the center electron beam, whereas the deflection error correction electrode 39 of the sides remote from the center electron beam increases its length as it is away from E and assumes a length $l_6$ at the end portions.

With the deflection error correction electrodes 39 of such a shape being placed in the deflecting magnetic field of FIG. 3, it is allowed to change the amount of correcting the deflection error depending upon when the electron beams located aside are deflected toward the right or toward the left on the surface of the paper, and to decrease the coma caused by the deflecting magnetic field.

The potential to be applied thereto may be different from that applied to the electron gun. The sizes $l_5$, $l_6$ and the position of installation are not definitely determined since they may vary depending upon the characteristics of the electron gun that is employed, structure of the cathode-ray tube, conditions for driving the cathode-ray tube, and the object of using the cathode-ray tube. The gap of the opposing portions may not be parallel flat plates.

Figure 26:
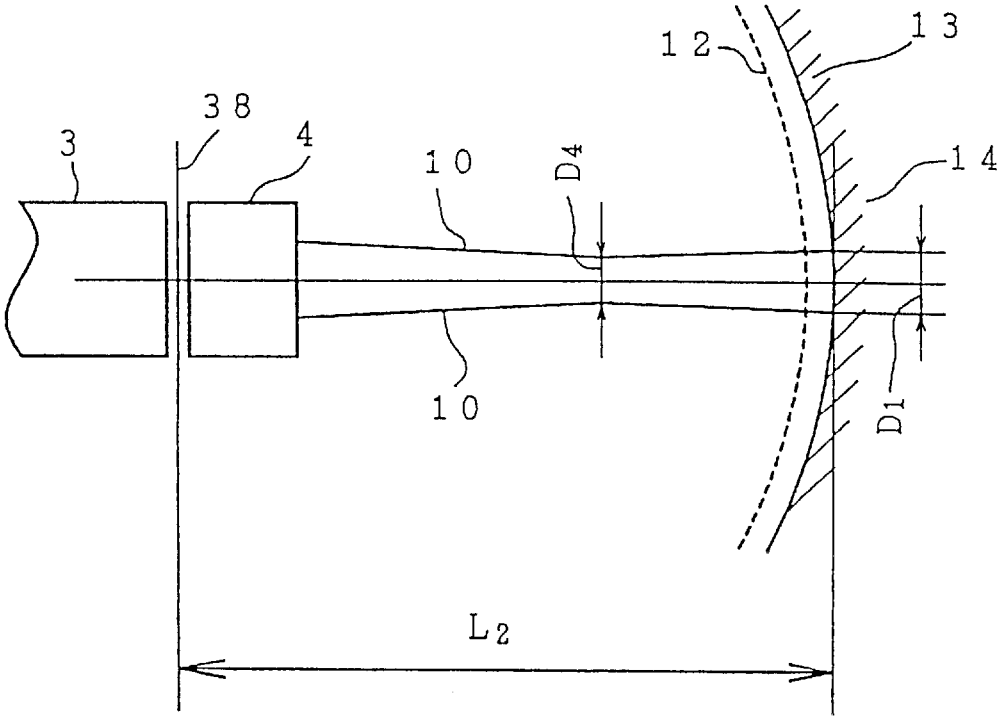
FIG. 26 is a diagram schematically illustrating the state of electron beams between the main lens of the electron gun and the fluorescent screen.

FIG. 26 is a diagram schematically illustrating a state of the electron beam between the main lens of the electron gun and the fluorescent screen. A positive potential is maintained in the whole region between the anode 4 of the electron gun and the fluorescent screen 13; i.e., no electric field is established in this region which, therefore, is called drift space.

The electron beams 10 that have received the focusing action from the main lens 38 are further focused toward the fluorescent screen 13. In this case, the electron beams are producing a diverging force due to the charge of the electrons, i.e., producing repulsive action due to space charge. The electron beams acquire the smallest diameter $D_4$ on the way to the fluorescent screen. Thereafter, the diverging force due to the repulsion of space charge becomes larger than the focusing action produced by the main lens, and a spot of a diameter $D_1$ larger than $D_4$ is formed on the fluorescent screen.

Figure 27:
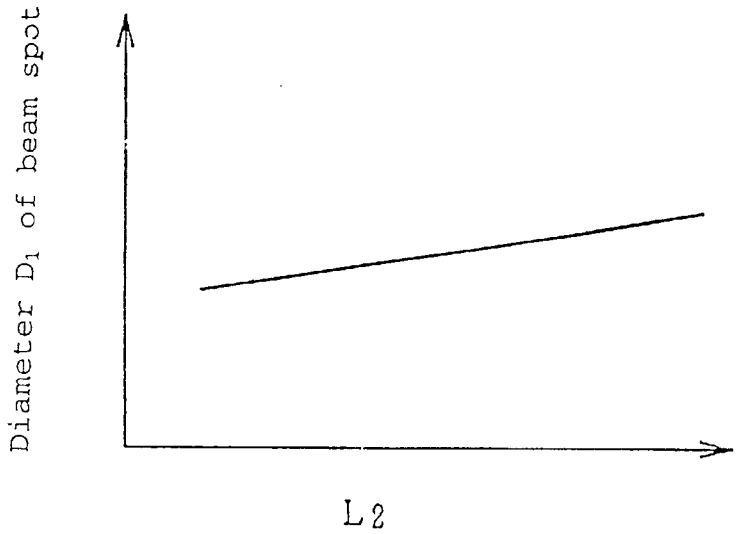
FIG. 27 is a diagram illustrating the diameter of the spot of an electron beam in relation to the distance between the main lens and the fluorescent screen.

FIG. 27 is a diagram illustrating a relationship between the diameter of the electron beam spot and the distance from the main lens to the fluorescent screen. As shown in FIG. 27, the phenomenon described with reference to FIG. 26 appears conspicuously and the resolution decreases with an increase in the distance $L_2$ between the main lens and the fluorescent screen.

When the electron gun has the same specifications, magnification for projecting an imaginary point near the cathode of the electron gun onto the fluorescent screen increases with an increase in the distance $L_2$, and the diameter of the spot formed on the fluorescent screen 13 increases resulting in a decrease in the resolution. On account of the above two reasons, a decrease in the distance between the main lens and the fluorescent screen makes it possible to increase resolution at the center of the fluorescent screen.

In the cathode-ray tube, in general, the electron beam has the greatest diameter near the main lens of the electron gun. The electron beam having a larger diameter is subject to be more affected by the deflecting magnetic field, and the deflection error increases.

Figure 28:
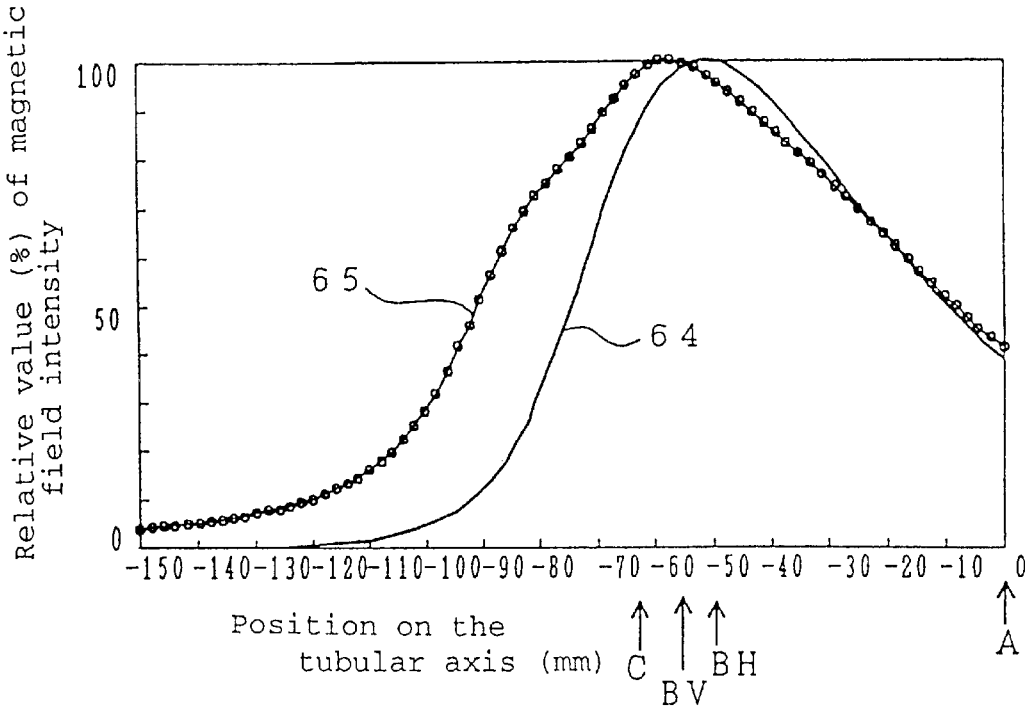
FIG. 28 is a diagram illustrating a practical distribution of magnetic field on the tubular axis formed by the deflecting yokes.
Figure 29:
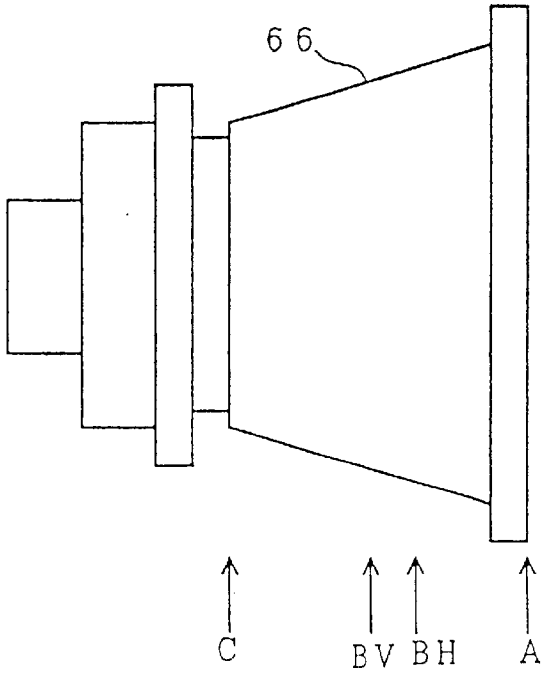
FIG. 29 is a side view of the deflecting yoke having a magnetic field distribution as shown in FIG. 28.
Figure 30A:
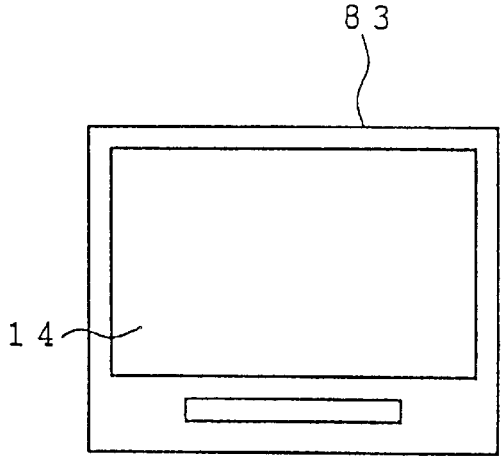
FIG. 30 is a diagram illustrating the size of a picture display device using the color cathode-ray tube. of the present invention in comparison with the size of a picture display device using a conventional color cathode-ray tube.
Figure 30B:
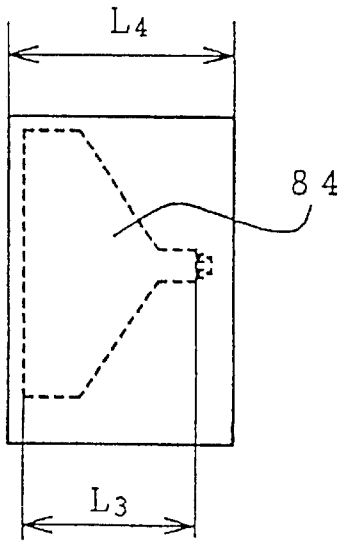
Figure 30C:
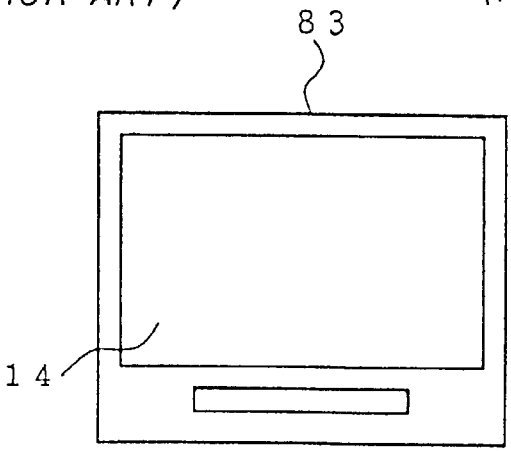
FIG. 30(c) (PRIOR ART)
Figure 30D:
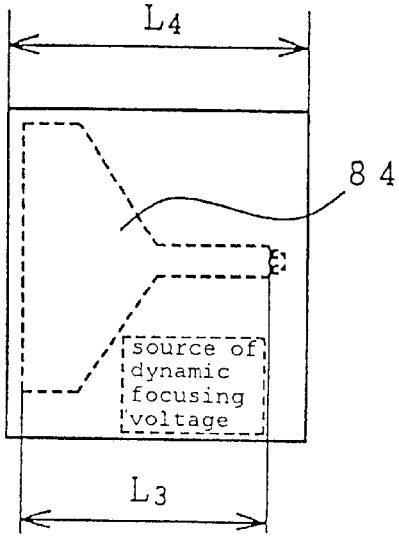
FIG. 30(d) (PRIOR ART)

FIG. 28 is a diagram illustrating a practical magnetic field distribution on the tubular axis formed by the deflecting yokes, and positions C, BV, BH and A along the tubular axis of the deflection yokes 66 of FIG. 29 correspond to the positions of the same symbols on the tubular axis of FIG. 28.

In FIG. 28, the right side is close to the fluorescent screen, the left side is remote from the fluorescent screen, A denotes a position which serves as a reference for measuring the magnetic field, BH denotes a position at which the magnetic flux density 64 of a magnetic field deflected in the direction of scanning lines assumes the greatest value, BV denotes a position at which the magnetic flux density 65 of a magnetic field deflected in a direction at right angles with the scanning lines assumes the greatest value, and C denotes an end of the magnetic material forming the core of a coil that generates the deflecting magnetic field on the side away from the fluorescent screen.

Even in the conventional cathode-ray tube, the resolution at the center of the fluorescent screen can be improved by decreasing the distance between the main lens and the fluorescent screen. As the deflecting magnetic field shown in FIG. 28 approaches the main lens, however, the resolution decreases greatly in the periphery of the screen due to an increase in the deflection error. In practice, therefore, the distance could not be decreased between the main lens and the fluorescent screen.

According to the present invention, on the other hand, the deflection error correction electrodes located in the deflecting magnetic field effects the correction by taking the effect of the deflecting magnetic field into account. It is therefore allowed to bring the main lens close to the deflecting magnetic field, and the distance can be decreased between the main lens and the fluorescent screen making it possible to improve resolution at the center of the fluorescent screen.

In other words, according to the present invention, the effect can be exhibited within a range which does not cause hindrance provided the distance is selected to be not longer than 40 mm between the end of the magnetic material forming the core on the side away from the fluorescent screen to the end of the deflection error correction electrodes on the side of the fluorescent screen. Here, the level of the magnetic flux density at the end of the deflection error correction electrode on the side of the fluorescent screen is not smaller than 25% of the maximum magnetic flux density.

According to the constitution of the present invention as described above, a fixed nonuniform electric field is formed in the deflecting magnetic field produced by a deflecting device in order to correct the deflection error depending upon the amount of deflection. In this case, the deflection error correction electrodes, which correct the deflection error depending upon the amount of deflection by forming the nonuniform electric field, function to adjust the mount of deflection individually for the electron beam located at the center and for the electron beams located aside. Therefore, it is made possible to control the convergence over the whole fluorescent screen even by using deflecting yokes without a function for correcting the coma.

Owing to the action for correcting the deflection error depending upon the amount of deflection, furthermore, it is allowed to provide a color cathode-ray tube which features improved uniformity in the resolution over the whole fluorescent screen, improved resolution at the center of the fluorescent screen as a result of shortening the distance between the fluorescent screen and the main lens and suppressing the effect of repulsion of space charge, and further features decreased overall length and decreased coma.

FIG. 30 is a diagram comparing the size of a picture display device using the color cathode-ray tube according to the present invention with the size of a picture display device using a conventional cathode-ray tube, wherein the diagrams (a) and (b) are a front view and a side view of the device using the color cathode-ray tube of the present invention, and the diagrams (c) and (d) are a front view and a side view of the device using the conventional cathode-ray tube.

Referring to FIG. 30, the depth $L_4$ of the cabinet 83 of the picture display device according to the present invention (diagram b) is shorter than that of the prior art (diagram d), and space for installation can be saved.

The depth $L_4$ is shortened owing to the fact that the main lens of the electron gun in the color cathode-ray tube is brought closer to the deflecting yokes as a result of correcting the deflection error depending upon the angle of deflecting the electron beams by forming a fixed nonuniform electric field in the deflecting magnetic field, and that the length $L_3$ of the color cathode-ray tube 84 is thus shortened.

Industrial Applicability

As described,above, the color cathode-ray tube according to the present invention does not develop color deviation on the picture and displays picture of a high quality, and is suited for being used in a picture display device contained in a cabinet having a shortened depth.

I claim:

1. A color cathode-ray tube comprising:

an electron gun including cathodes for forming three electron beams in line including a central electron beam and two side electron beams, electrodes forming a main lens for shaping said electron beams, and a shield electrode arranged neighboring the electrodes forming the main lens along the tubular axis to protect said shaped electron beams from the external environment;

deflection yokes generating a deflecting magnetic field to deflect said electron beams in the in-line direction and in a direction at right angles with the in-line direction; and a fluorescent screen which emits light when irradiated with said deflected electron beams to form a picture;

wherein the shield electrode of said electron gun is arranged in the region of the deflecting magnetic field of said deflecting yokes, deflection error correction electrodes are provided so as to extend from a bottom of said shield electrode toward said fluorescent screen, said bottom of said shield electrode being disposed on a side of said cathodes and having at least one aperture through which said three electron beams pass, said deflection error correction electrodes forming a nonuniform electric field to change the diameter of the beams depending upon the amount of deflecting said electrons beams; and said deflection error correction electrodes function to change the amount of deflection individually for the central electron beam and for the side electron beams.

2. A color cathode-ray tube according to claim 1, wherein said deflection error correction electrodes have opposing portions between which the passage of said three electron beams is sandwiched from a direction at right angles with said in-line direction, and magnetic materials are provided on the opposing portions near the passage of the side electron beams.

3. A color cathode-ray tube according to claim 2, wherein said magnetic materials are provided on back surfaces of the opposing portions of said deflection error correction electrodes at positions corresponding to the passage of the side electron beams.

4. A color cathode-ray tube according to claim 2, wherein said magnetic materials are constituted of a first plate portion having a surface nearly in parallel with said in-line direction and a second plate portion having a surface nearly perpendicular to said in-line direction, said first plate portion is so arranged that the passage of said side electron beams is sandwiched from the direction at right angles to said in-line direction, and said second plate portion is so arranged that its end is opposed to the side of the passage of said side electron beams opposite to the passage of said central electron beam.

5. A color cathode-ray tube according to claim 2, wherein said magnetic materials are constituted of a first plate portion having a surface nearly perpendicular to the direction of said tubular axis and a second plate portion having a surface nearly perpendicular to said in-line direction, said first plate portion is so arranged that the passage of said side electron beams is sandwiched from the direction at right angles to said in-line direction, and said second plate portion is so arranged that its end is opposed to the side of the passage of said side electron beams opposite to the passage of said central electron beam.

6. A color cathode-ray tube according to claims 2 to 5, wherein said magnetic materials are constituted of a ferromagnetic material.

7. A color cathode-ray tube according to claim 1, wherein said deflection error correction electrodes have portions thereof at least proximate to the passage of the side electron beams are constituted of a magnetic material.

8. A color cathode-ray tube according to claim 7, wherein said deflection error correction electrodes have portions opposed to each other while sandwiching the passage of said side electron beams therebetween from a direction at right angles with said in-line direction, said portions protruding toward said fluorescent screen and being constituted of a magnetic material.

9. A color cathode-ray tube according to claim 1, wherein the nonuniform electric field formed by said deflection error correction electrodes is an astigmatic electric field.

10. A color cathode-ray tube according to claim 9, wherein said deflection error correction electrodes have portions opposed to each other while sandwiching the passage of said three electron beams therebetween from a direction at right angles with said in-line direction, and the length of the opposing portions in the direction of said tubular axis is shortened at portions corresponding to the passage of the side electron beams compared to the portion corresponding to the passage of said central electron beam.

11. A color cathode-ray tube according to claim 1, wherein the nonuniform electric field formed by said deflection error correction electrodes is a coma electric field.

12. A color cathode-ray tube according to claim 11, wherein said deflection error correction electrodes have opposing portions between which the passage of said three electron beams is sandwiched from a direction at right angles with the in-line direction, and the length of the opposing portions in the direction of said tubular axis at portions corresponding to the passage of said side electron beams of is increased compared to the one for the passage of said central electron beam as it is away from the side opposite to the passage of said central electron beam.

13. A color cathode-ray tube according to claim 1, wherein said deflection error correction electrodes have an electric potential applied thereto for forming the nonuniform electric field.

14. A color cathode-ray tube comprising:

an electron gun including cathodes for forming three electron beams in line including a central electron beam and two side electron beams, electrodes forming a main lens for shaping said electron beams, and a shield electrode arranged neighboring the electrodes forming the main lens along the tubular axis to protect said shaped electron beams from the external environment;

deflection yokes generating a deflecting magnetic field to deflect said electron beams in the in-line direction and in a direction at right angles with the in-line direction; and a fluorescent screen which emits light when irradiated with said deflected electron beams to form a picture;

wherein the shield electrode of said electron gun is arranged in the region of the deflecting magnetic field of said deflecting yokes, a common single aperture is formed in a bottom of said shield electrode which is disposed on a side of said cathodes to permit passage of said three electron beams, deflection error correction electrodes are provided to form a nonuniform electric field on a side closer to said fluorescent screen than said single aperture in order to change the diameter of the beams depending upon the amount of deflecting said electrons beams; and said deflection error correction electrodes function to change the amount of deflection individually for the central electron beam and for the side electron beams.

15. A color cathode-ray tube according to claim 14, wherein said deflection error correction electrodes have an electric potential applied thereto for forming the nonuniform electric field.

16. A color cathode-ray tube comprising:

an electron gun including cathodes for forming three electron beams in line including a central electron beam and two side electron beams, electrodes forming a main lens for shaping said electron beams, and a shield electrode arranged neighboring the electrodes forming the main lens along the tubular axis to protect said shaped electron beams from the external environment;

deflection yokes having a coil and a core and generating a deflecting magnetic field to deflect said electron beams in the in-line direction and in a direction at right angles with the in-line direction; and a fluorescent screen which emits light when irradiated with said deflected electron beams to form a picture;

wherein deflection error correction electrodes are provided to form a nonuniform electric field on a side closer to said fluorescent screen than to at least one aperture formed in a bottom of said shield electrode which is disposed on a side of said cathodes and through which said three electron beams pass, in order to change the diameter of the beams depending upon the amount of deflecting said electron beams, and a distance in a direction of said tubular axis is set to be not longer than 40 mm from an end of the core of said deflecting yoke which is disposed on the side of the cathodes to an end of said deflection error correction electrodes which is disposed on the side of the fluorescent screen; and said deflection error correction electrodes function to change the amount of deflection individually for the central electron beam and for the side electron beams.

17. A color cathode-ray tube according to claim 16, wherein said deflection error correction electrodes have an electric potential applied thereto for forming the nonuniform electric field.

* * * * *